US006892433B2

(12) United States Patent
Barry et al.

(10) Patent No.: US 6,892,433 B2
(45) Date of Patent: May 17, 2005

(54) MANUFACTURING METHOD OF ASSEMBLING TEMPERATURE CONTROLLED RAILWAY CAR

(75) Inventors: Robert J. Barry, Arlington, TX (US); Gary W. Kirk, Jr., Piedmont, OK (US); Joseph A. Seiter, Edmond, OK (US); Allen E. Norton, Arlington, TX (US); Ronald J. Zupancich, Cortland, TX (US)

(73) Assignee: TRN Business Trust, Dallas, TX (US)

( * ) Notice: Subject to any disclaimer, the term of this patent is extended or adjusted under 35 U.S.C. 154(b) by 430 days.

(21) Appl. No.: 10/071,513

(22) Filed: Feb. 8, 2002

(65) Prior Publication Data

US 2002/0148196 A1 Oct. 17, 2002

Related U.S. Application Data

(60) Provisional application No. 60/267,882, filed on Feb. 9, 2001.

(51) Int. Cl.[7] ..... B23P 21/00; B23P 11/00; B23P 19/04

(52) U.S. Cl. ..... 29/469; 29/428; 29/460

(58) Field of Search ..... 29/469, 428, 436, 29/455.1, 460, 525.14; 52/742.1, 749.15, 404.1; 105/404, 355, 409, 413, 423; 296/39.3

(56) References Cited

U.S. PATENT DOCUMENTS

| | | | | |
|---|---|---|---|---|
| 3,003,810 | A | 10/1961 | Kloote et al. | 296/31 |
| 3,142,265 | A | 7/1964 | Ford | 105/423 |
| 3,187,853 | A | 6/1965 | Glaser et al. | 189/34 |
| 3,206,946 | A | 9/1965 | Lindersmith et al. | 62/407 |
| RE26,131 | E | 12/1966 | Johansson et al. | 105/409 |
| 3,301,147 | A | 1/1967 | Clayton et al. | |
| 3,323,471 | A | 6/1967 | Dean et al. | 105/401 |
| 3,481,642 | A | 12/1969 | Bonallack et al. | 296/31 |
| 3,711,148 | A | 1/1973 | Hindin | 296/28 |
| 3,777,430 | A | 12/1973 | Tischuk | 52/309 |
| 4,122,641 | A | 10/1978 | Bard et al. | 52/403 |
| 4,404,057 | A | 9/1983 | Morrison et al. | 156/324 |
| 5,088,434 | A | 2/1992 | Harding | 114/85 |
| 5,109,777 | A | 5/1992 | Ohmura et al. | 105/401 |
| 5,113,769 | A | 5/1992 | Okuno et al. | 105/422 |
| 5,274,979 | A | 1/1994 | Tsai | 52/595 |
| 5,277,011 | A | 1/1994 | Serrano Martin | 52/588 |
| 5,333,554 | A | 8/1994 | Yamada et al. | 105/397 |
| 5,403,063 | A | 4/1995 | Sjostedt et al. | 296/187 |
| 5,460,290 | A | * 10/1995 | Hanning et al. | 220/694.1 |
| 5,677,029 | A | 10/1997 | Prevorsek et al. | 428/113 |
| 5,685,229 | A | 11/1997 | Ohara et al. | 105/397 |
| 5,716,487 | A | 2/1998 | Sumerak | 156/359 |
| 5,730,485 | A | 3/1998 | Sjostedt et al. | 296/182 |
| 5,765,485 | A | 6/1998 | Thoman et al. | 105/404 |
| 5,802,984 | A | * 9/1998 | Thoman et al. | 105/404 |
| 5,988,074 | A | 11/1999 | Thoman | 105/404 |
| 6,000,342 | A | 12/1999 | Thoman et al. | 105/413 |
| 6,138,580 | A | 10/2000 | Thoman | 105/396 |
| 6,227,125 | B1 | 5/2001 | Schroeder et al. | 105/401 |
| 6,233,892 | B1 | 5/2001 | Tylman | 52/309.12 |
| 6,251,185 | B1 | 6/2001 | Morrison et al. | 118/681 |
| 6,290,279 | B1 | 9/2001 | Haight et al. | 296/97.23 |

* cited by examiner

*Primary Examiner*—John C. Hong
(74) *Attorney, Agent, or Firm*—Baker Botts L.L.P.

(57) ABSTRACT

A manufacturing facility and method for assembling a composite box structure on a railway car underframe are provided. The composite box structure may be defined in part by an exterior metal surface, interior side stakes attached to the exterior metal surface, foam insulation disposed between the side stakes and attached to the metal surface and at least one layer of reinforced plastic material forming an interior surface. The composite box structure preferably includes a pair of end walls, a pair of side walls, a floor assembly and a roof assembly. The composite box structure may be assembled on a railway car underframe to form a temperature controlled boxcar or on insulated boxcar.

27 Claims, 11 Drawing Sheets

43
40
45
38
45
44
142
130
140
48
48
47
130
74
46
39
46
39
74
128
129
58
58
32
126
60
60
30
126
127
127
54
61
61
58
120
122
58
56
60
60
126
126
53
127
127
53
75
100
82
84a
88
75
55
55
246
246
54
221
248
248
221
84b
220
222
230
230
223
200
223

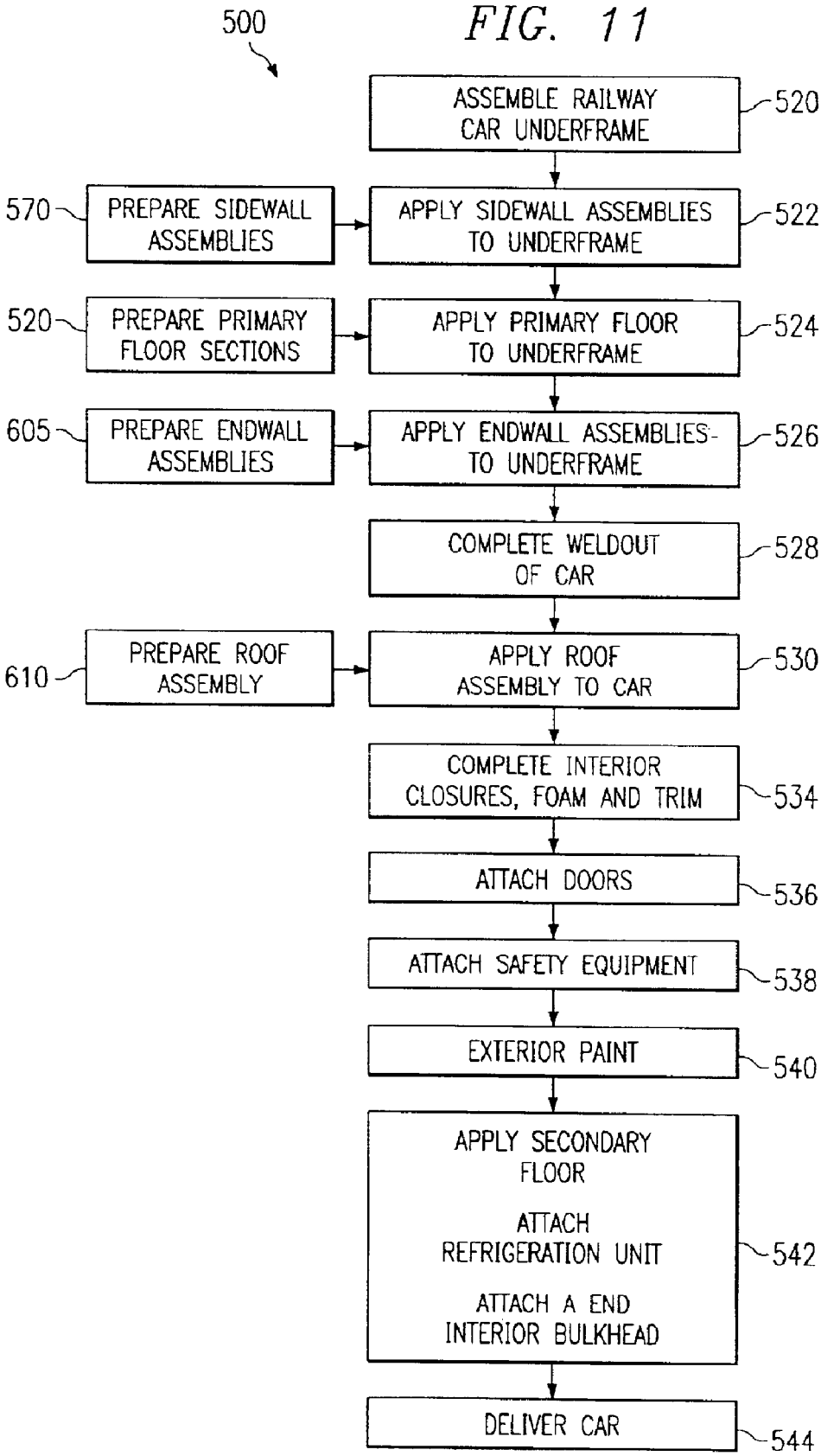
500
FIG. 11
ASSEMBLE RAILWAY CAR UNDERFRAME
520
570
PREPARE SIDEWALL ASSEMBLIES
APPLY SIDEWALL ASSEMBLIES TO UNDERFRAME
522
520
PREPARE PRIMARY FLOOR SECTIONS
APPLY PRIMARY FLOOR TO UNDERFRAME
524
605
PREPARE ENDWALL ASSEMBLIES
APPLY ENDWALL ASSEMBLIES TO UNDERFRAME
526
COMPLETE WELDOUT OF CAR
528
610
PREPARE ROOF ASSEMBLY
APPLY ROOF ASSEMBLY TO CAR
530
COMPLETE INTERIOR CLOSURES, FOAM AND TRIM
534
ATTACH DOORS
536
ATTACH SAFETY EQUIPMENT
538
EXTERIOR PAINT
540
APPLY SECONDARY FLOOR
ATTACH REFRIGERATION UNIT
ATTACH A END INTERIOR BULKHEAD
542
DELIVER CAR
544

MANUFACTURING METHOD OF ASSEMBLING TEMPERATURE CONTROLLED RAILWAY CAR

RELATED APPLICATION

This application claims the benefit of provisional application entitled, "Temperature Controlled Railway Car", Ser. No. 60/267,882 filed Feb. 9, 2001.

This application is related to copending patent application entitled, "Pultruded Panel", Ser. No. 10/071,165, filed Feb. 8, 2002, now abandoned; copending patent application entitled, "Roof Assembly and Airflow Management System For A Temperature Controlled Railway Car", Ser. No. 10/071,173, filed Feb. 8, 2002, now U.S. Pat. No. 6,722,287; and copending application entitled, "Temperature Controlled Railway Car", Ser. No. 10/071,168, filed Feb. 8, 2002, now U.S. Pat. No. 6,575,102, which claim priority from the same provisional application.

TECHNICAL FIELD

The present invention is related to a manufacturing facility and method of assembling a railway car and more particularly forming components of a composite box structure and attacheng the components to a railway car underframe.

BACKGROUND OF THE INVENTION

Over the years, general purpose railway boxcars have progressed from relatively simple wooden structures mounted on flat cars to more elaborate arrangements including insulated walls and refrigeration equipment. Various types of insulated boxcars are presently manufactured and used. A typical insulated boxcar includes an enclosed structure mounted on a railway car underframe. The enclosed structure generally includes a floor assembly, a pair of side walls, a pair of end walls and a roof. The side walls, end walls and roof often have an outer shell, one or more layers of insulation and interior paneling.

The outer shell of many railway boxcars often has an exterior surface formed from various types of metal such as steel or aluminum. The interior paneling is often formed from wood and/or metal as desired for the specific application. For some applications the interior paneling has been formed from fiber reinforced plastic (FRP). Various types of sliding doors including plug type doors are generally provided on each side of conventional boxcars for loading and unloading freight. Conventional boxcars may be assembled from various pieces of wood, steel and/or sheets of composite materials such as fiberglass reinforced plastic. Significant amounts of raw material, labor and time are often required to complete the manufacture and assembly of conventional boxcars.

The underframe for many boxcars include a center sill with a pair of end sill assemblies and a pair of side sill assemblies arranged in a generally rectangular configuration corresponding approximately with dimensions for the floor of the boxcar. Cross bearers are provided to establish desired rigidity and strength for transmission of vertical loads to the associated side sills which in turn transmit the vertical loads to the associated body bolsters and for distributing horizontal end loads on the center sill to other portions of the underframe. Cross bearers and cross ties cooperate with each other to support a plurality of longitudinal stringers. The longitudinal stringers are often provided on each side of the center sill to support the floor of a boxcar. Examples of such railway car underframes are shown in U.S. Pat. Nos. 2,783,718 and 3,266,441.

Some railway cars or boxcars may be manufactured using side wall assemblies with all or portions of a respective side sill assembly formed as an integral component thereof. In a similar manner, such railway cars and/or boxcars may also be manufactured with end wall assemblies having all or portions of a respective end sill formed as an integral component thereof.

Traditionally, refrigerated boxcars often have less inside height than desired for many types of lading and a relatively short interior length. Heat transfer rates for conventional insulated boxcars and refrigerated boxcars are often much greater than desired. Therefore, refrigeration systems associated with such boxcars must be relatively large to maintain desired temperatures while shipping perishable lading.

A wide variety of composite materials have been used to form railway cars and particular boxcars. U.S. Pat. No. 6,092,472 entitled "Composite Box Structure For A Railway Car" and U.S. Pat. No. 6,138,580 entitled "Temperature Controlled Composite Boxcar" show some examples. One example of a composite roof for a railway car is shown in U.S. Pat. No. 5,988,074 entitled "Composite Roof for a Railway Car".

Ballistic resistant fabrics such as Bulitex scuff and wall liners have previously been used to form liners for highway truck trailers.

SUMMARY OF THE INVENTION

In accordance with teachings of the present invention, several disadvantages and problems associated with manufacture and assembly of insulated boxcars, refrigerated boxcars and other types of temperature controlled railway cars have been substantially reduced or eliminated. One embodiment of the present invention includes a composite box structure with a temperature control system and an airflow management system satisfactory for use with a refrigerated boxcar or a temperature controlled railway car. Another embodiment of the present invention includes a composite box structure which may be satisfactory for use with an insulated boxcar.

A composite box structure formed in accordance with teachings of the present invention combines the benefits conventional railway car components with the benefits of advanced plastic and composite materials. For one application a temperature controlled railway car may be formed in accordance with teachings with the present invention with enlarged interior dimensions of approximately seventy two feet, two inches inside length, nine feet, two inches inside width and an inside height at the center line of twelve feet, one and one half inches. A composite box structure formed in accordance with teachings of the present invention provides enhanced insulation, increased load carrying capacity, better temperature regulation, increased service life, and reduced maintenance costs as compared to a typical refrigerated boxcar.

The present invention allows designing side wall assemblies and end wall assemblies with insulating materials having optimum thickness to substantially minimize heat transfer rates between the interior and the exterior of a resulting composite box structure and to maximize interior load carrying capacity. Structural integrity of a resulting composite box structure may be maintained using conventional materials such as steel alloys to form exterior portions of the side wall assemblies and end wall assemblies.

A railway car may be formed in accordance with teachings of the present invention with similar or reduced costs as compared to conventional refrigerated boxcars and insulated boxcars with substantially improved load carrying capacity and thermal energy characteristics. Many structural members of the resulting railway car may be formed from steel alloys and other materials which may be easily repaired as compared with some composite materials. Composite materials with substantially improved insulation characteristics are used as nonstructural members to improve heat transfer characteristics while at the same time increasing load carrying capability.

Technical benefits of the present invention include relatively flexible joints or flexible connections between side wall assemblies and the end assemblies to allow limited movement of these components relative to each other. Flexible joints or flexible connections may also be provided to allow expansion and contraction of a roof assembly and/or floor assembly relative to other components in response to temperature changes while maintaining desired structural integrity of an associated composite box structure.

One aspect of the present invention includes forming side wall assemblies and end wall assemblies defined in part by a plurality of support posts or end beams with metal side sheets attached to one side of the support posts or end beams and at least one layer of ballistic resistant fabric attached to the opposite side of the support posts or end beams with void spaces formed therebetween.

Fabricating side wall assemblies and end wall assemblies with respective side sill assembly and end sill assembly in accordance with teachings of the present invention allows optimizing associated fabrication techniques and reduces both cost and time required to complete manufacture and assembly of the resulting temperature controlled railway car or insulated boxcar. Various benefits associated with fabricating side wall assemblies and end wall assemblies in accordance with teachings of the present invention will be discussed throughout this patent application.

BRIEF DESCRIPTION OF THE DRAWINGS

For a more complete understanding of the present invention, and the advantages thereof, reference is now made to the following written description taken in conjunction with the accompanying drawings, in which:

FIG. 11 is a block diagram showing one example of a method for assembling a temperature control railway car in accordance with teachings of the present invention;

DETAILED DESCRIPTION OF THE INVENTION

Preferred embodiments of the invention and its advantages are best understood by reference to FIGS. 1A–20 of the drawings, like numerals are used for like and corresponding parts of the various drawings.

Various aspects of the present invention will be described with respect to temperature control railway car 20. However, the present invention is not limited to temperature controlled railway cars. For example, various features of the present invention may be satisfactory used to form insulated boxcars and other types of freight cars or railway cars having side wall assemblies and end wall assemblies mounted on a railway car underframe.

Figure 1A:
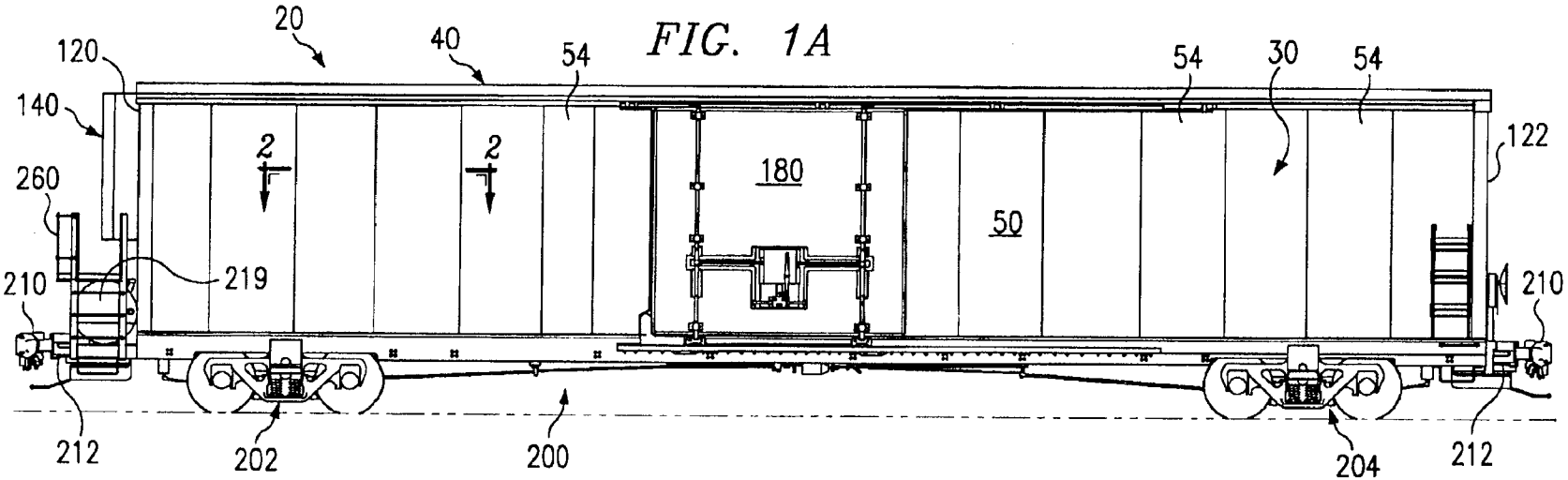
FIG. 1A is a schematic drawing in elevation showing a side view of a temperature controlled railway car having a composite box structure with a temperature control system and an airflow management system incorporating teachings of the present invention.
Figure 1B:
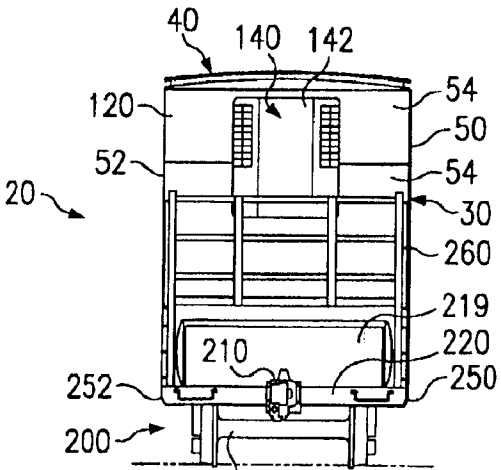
FIG. 1B is an end view of the temperature controlled railway car of FIG. 1A.
Figure 5:
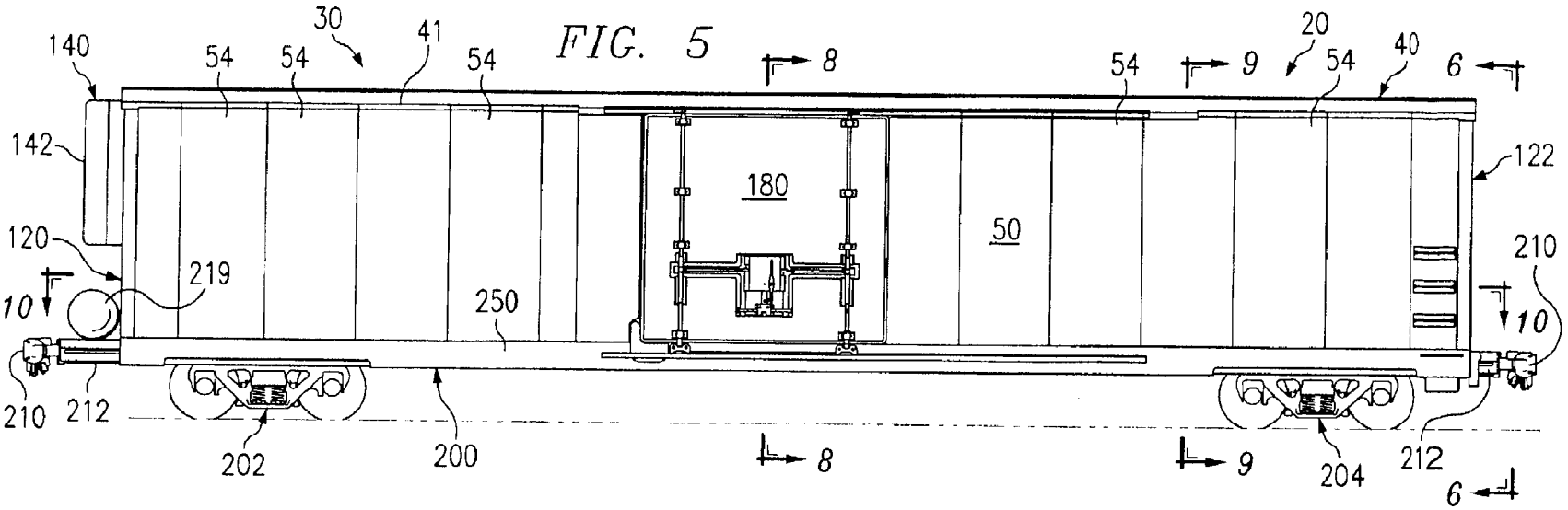
FIG. 5 is a schematic drawing in elevation showing the railway car of FIG. 1A prior to attaching safety appliances and an end platform.

Temperature controlled railway car 20 incorporating teachings of the present invention is shown in FIGS. 1A, 1B and 5 with composite box structure 30 mounted on railway car underframe 200. As discussed later in more detail, temperature controlled railway car 20 may include temperature control system 140 and airflow management system 300.

For embodiments of the present invention as shown in FIGS. 1A–10, temperature controlled railway car 20 may have exterior dimensions which satisfy requirements of Plate F and associated structural design requirements of the Association of American Railroads (AAR). Forming various components of composite box structure 30 in accordance with teachings of the present inventions and assembling these components on railway car underframe 200 results in reducing the weight of temperature controlled railway car 20 while at the same time increasing both internal volume and load carrying capacity as compared to a conventional refrigerated boxcar satisfying Plate F requirements. A composite box structure and associated insulated boxcar or temperature controlled railway car may be formed in accordance with teachings of the present invention to accommodate various geometric configurations and load carrying requirements to meet specific customer needs concerning size and temperature specifications for different types of lading carried in the resulting railway car.

The term "composite box structure" refers to a generally elongated structure having a roof assembly, a floor assembly, a pair of side wall assemblies, and a pair of end wall assemblies which cooperate with each other to provide a generally hollow interior satisfactory for carrying various types of lading associated with insulated boxcars and refrigerated boxcars. Portions of the roof assembly, floor assembly, side wall assemblies and/or end wall assemblies may be formed from conventional materials such as steel alloys and other metal alloys used to manufacture railway cars. Portions of the roof assembly, floor assembly, side wall assemblies and/or end wall assemblies may also be formed from composite materials such as advanced thermal plastics, insulating foam, glass fiber pultrusions and fiber reinforced materials such as ballistic resistant fabrics. Examples of some of the materials used to form a composite box structure for a temperature controlled railway car or an insulated boxcar incorporating teachings of the present invention will be discussed throughout this application.

The term "support post" may be used to refer to side posts, side stakes or other structural components satisfactory for use in forming a side wall assembly incorporating teachings of the present invention.

The term "end beam" may be used to refer to I beams or other structural components satisfactory for use in forming an end wall assembly incorporating teachings of the present invention. For some applications support posts and end beams may be formed from metal I beams having similar cross sections.

The term "FRP" may be used to refer to both fiber reinforced plastic and glass fiber reinforced plastic. A wide variety of fibers in addition to glass fibers may be satisfactorily used to form portions of a composite box structure incorporating teachings of the present invention.

Composite box structure 30 may be formed from several major components including roof assembly 40, side wall assemblies 50 and 52, floor assembly 80 and end wall assemblies 120 and 122. Major components associated with composite box structure 30 are preferably fabricated individually in accordance with teachings of the present invention and then attached to or assembled on railway car underframe 200 to form temperature controlled railway car 20. Individually manufacturing or fabricating major components of composite box structure 30 allows optimum use of conventional railcar manufacturing techniques. For example, side posts and door posts may be welded with top chords and side sill assemblies using conventional railcar manufacturing techniques to provide structural members for a side wall assembly.

Manufacturing procedures associated with thermoplastic materials and insulating foam may be modified in accordance with teachings of the present invention to form other portions of composite box structure 30. For example, side wall assemblies and end wall assemblies filled with foam insulation may be used to form portions of a composite box structure with substantially improved heat transfer characteristics as compared with conventional refrigerated boxcar floor assemblies.

Figure 2:
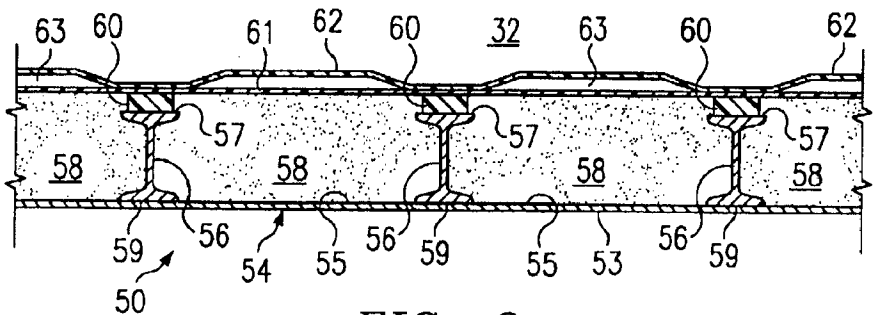
FIG. 2 is a schematic drawing in section with portions broken away taken along lines 2—2 of FIG. 1A showing portions of a side wall assembly incorporating teachings of the present invention.

Side wall assemblies 50 and 52 and end wall assemblies 120 and 122 may be formed using substantially similar techniques to form an exterior metal surface and an interior surface of fiber reinforced material with foam insulation bonded therebetween. FIG. 2 shows a typical cross section for side wall assembly 50. Since side wall assemblies 50 and 52 have substantially the same configuration and overall design, various features of the present invention will be discussed primarily with respect to side wall assembly 50.

For the embodiment of the present invention represented by composite box structure 30, side wall assembly 50 preferably includes a plurality of metal side sheets 54 disposed on the exterior of composite box structure 30. Each side sheet 54 preferably includes an exterior surface 53 and an interior surface 55. Exterior surfaces 53 of side sheets 54 cooperate with each other to form an exterior metal surface for side wall assembly 50 and composite box structure 30.

A plurality of support posts 56 are preferably attached to interior surface 55 of each side sheet 54 spaced from each other and extending inwardly towards interior 32 of composite box structure 30. Each support post 56 may include exterior surface 59 attached with adjacent portions of interior surface 55 of respective side sheet 54. For some applications isolators 60 may be attached with interior surface or first surface 57 of each support post 56.

For some applications isolators 60 may be formed from thermoplastic polymers such as polyvinyl chloride (PVC). Various other types of thermoplastic materials and other insulating materials may be satisfactorily used to form isolators 60 attached with interior surface or second surface 59 of each support post 56. The present invention is not limited to PVC type materials. Isolators 60 may have various configurations. For example, isolators 60 may be a strip of thermoplastic material extending along substantially the full length of the associated support post 56. Alternatively, isolators 60 may be formed from blocks of PVC material with alternating blocks (not expressly shown) of insulating foam disposed therebetween and attached to interior surface 57 of support posts 56. Attaching isolators 60 with interior surface 57 of support posts 56 substantially reduces heat transfer between associated support posts 56 and interior 32 of composite box structure 30. Alternating blocks of PVC material with blocks of insulating foam may provide even greater reductions in heat transfer rates between associated support posts 56 and interior 32 of composite box structure 30.

At least one layer of fiber reinforced material is preferably disposed on isolators 60 to form an interior surface of side wall assembly 50 and the associated composite box structure 30. For the embodiment of the present invention as shown in FIG. 2 side wall assembly 50 includes both first layer 61 of fiber reinforced material and second layer 62 of fiber reinforced material. A plurality of void spaces 63 may be formed between first layer 61 and second layer 62 of fiber reinforced material. Various types of adhesives and/or mechanical fasteners may be used to attach second layer 62 with first layer 61. For some applications second layer 62 may be nailed to first layer 61 by nails (not expressly shown) inserted into isolators 60.

Foam insulation 58 is preferably disposed between and bonded with adjacent portions of interior surface 55 of metal sheets 54, adjacent portions of support posts 56 and adjacent portions of fiber reinforced material 61. For some applications a layer of scrim (not expressly shown) may be attached to the interior of first layer 61 to enhance bonding with foam insulation 58. The scrim layer may be formed from non-woven fabric or any other suitable material for bonding with foam insulation 58.

Second layer 62 preferably includes a corrugated cross section which provides desired airflow paths 63 when lading is disposed adjacent to the interior surface of side wall assembly 50. The corrugated cross section of second layer 62 provides airflow paths which form a portion of airflow management system 300.

First layer 61 and second layer 62 are preferably formed from tough, light weight, rigid material having high impact resistance. Various polymeric materials may be used to form first layer 61 and second layer 62. For some applications only first layer 61 may be attached to a side wall assembly. For other applications, the thickness of second layer 62 may be increased and applies directly to isolators 60 without first layer 61. First layer 61 and second layer 62 are preferably formed from Bulitex material available from U.S. Liner Company, a division of American Made, Inc. Bulitex material may be generally described as a ballistic grade composite scuff and wall liner.

Various types of ballistic resistant fabric may also be satisfactorily used to provide a liner for a composite box structure in accordance with teachings of the present invention. Ballistic resistant fabrics are often formed with multiple layers of woven or knitted fibers. The fibers are preferably impregnated with low modulus elastomeric material as compared to the fibers which preferably have a high modulus. U.S. Pat. No. 5,677,029 entitled "Ballistic Resistant Fabric Articles" and assigned to Allied Signal shows one example of a ballistic resistant fabric.

For one application side sheet 54 may be formed from twelve (12) gauge steel. Support post 56 may be three (3) inch I-beams. Isolators 60 may have dimensions of approximately two (2) inches by two (2) inches by three-fourths (¾) of an inch. Foam insulation 58 may have a thickness of approximately four (4) inches. First layer 61 may be formed from Bulitex material having a thickness of approximately 0.06 inches. Second layer 62 may be formed from Bulitex material having a thickness of approximately 0.04 inches. The width of corrugations formed in second layer 62 may be between approximately four (4) and five (5) inches. The corrugations preferably formed airflow gaps 63 of approximately one-half (½) inch relative to first layer 61.

Figure 3:
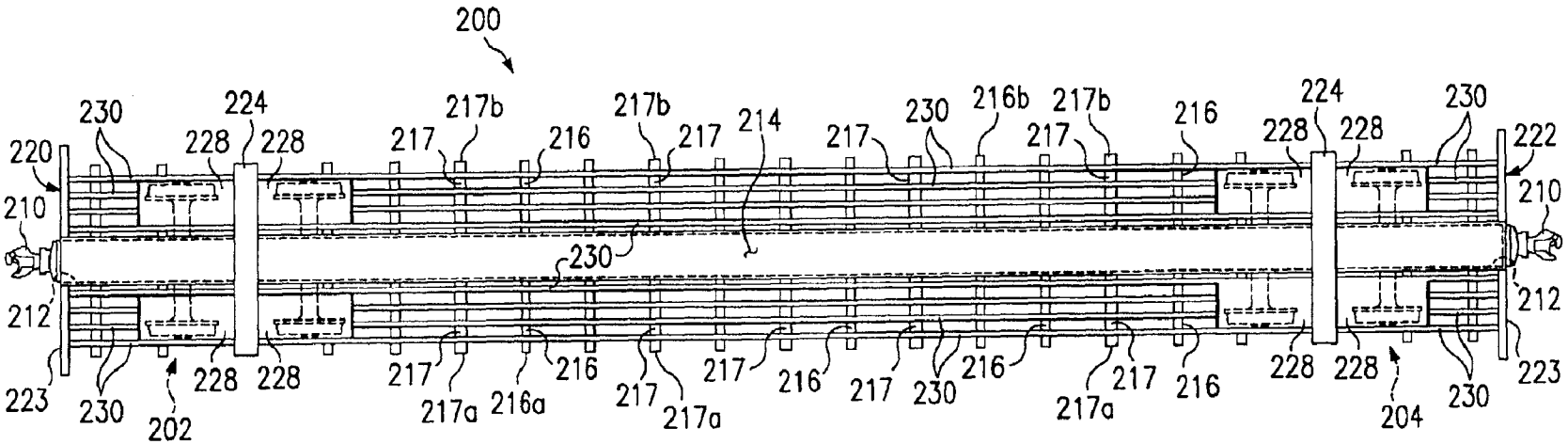
FIG. 3 is a schematic drawing showing a plan view of one example of a railway car underframe satisfactory for use in forming a temperature controlled railway car in accordance with teachings of the present invention.
Figure 4:
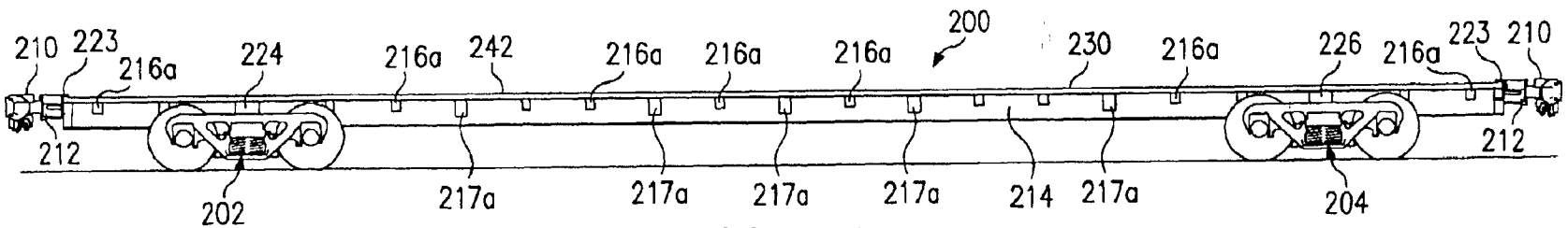
FIG. 4 is a schematic drawing showing a side view of the railway car underframe of FIG. 3.
Figure 7B:
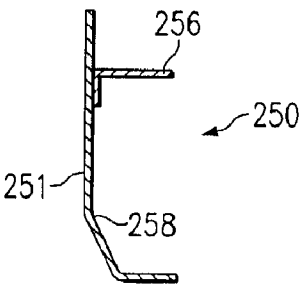
FIG. 7B is a drawing in section showing one example of a side sill assembly formed in accordance with teachings of the present invention.
Figure 6:
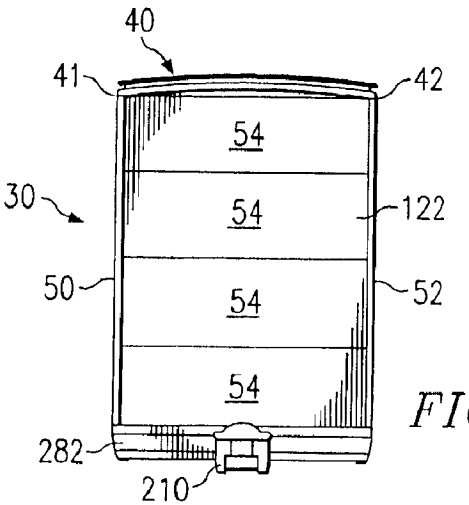
FIG. 6 is a schematic drawing in elevation with portion broken away, taken along lines 6—6 of FIG. 5, showing one example of metal sheets attached with an exterior surface of an end wall assembly in accordance with teachings of the present invention.
Figure 7A:
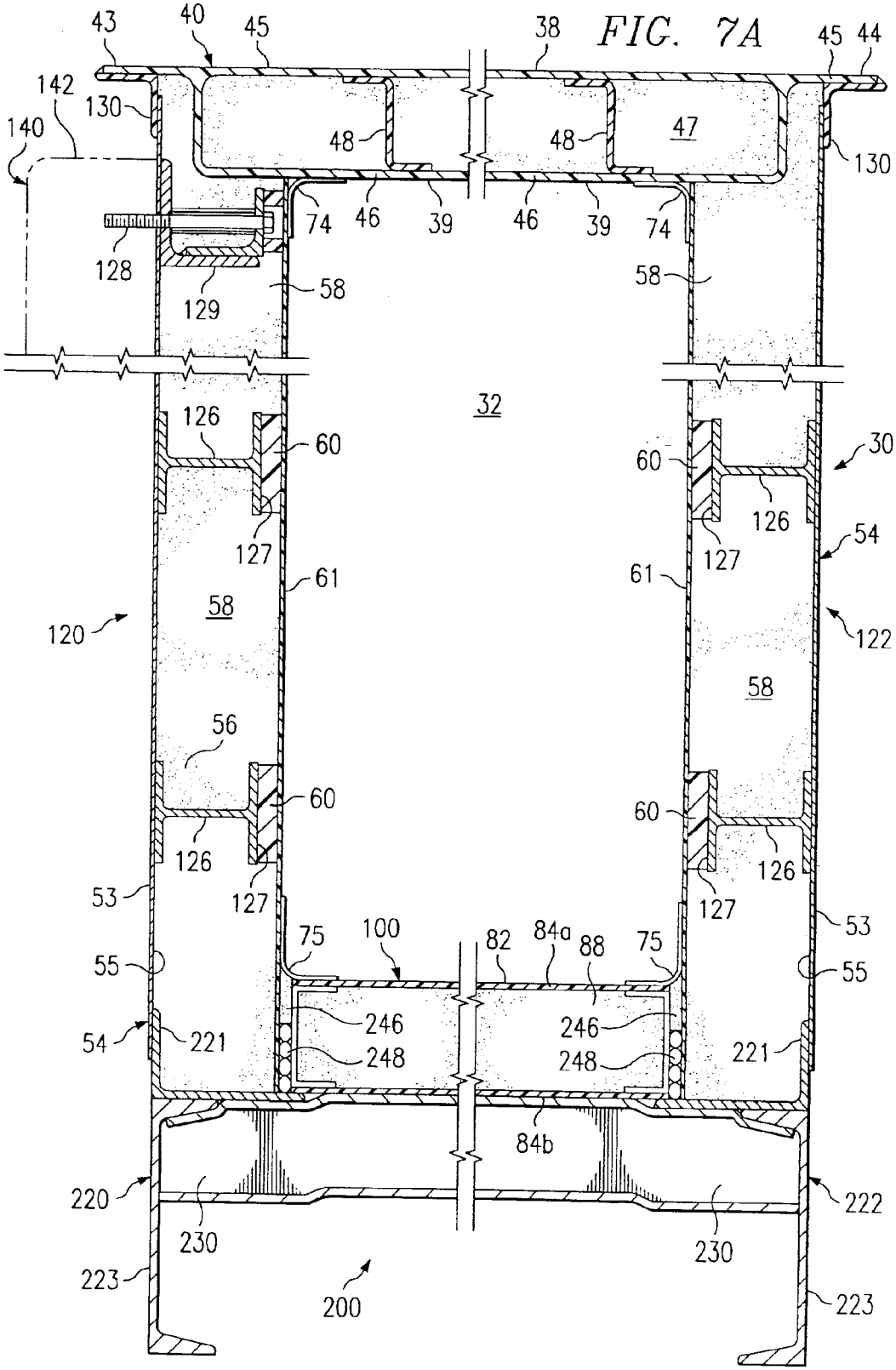
FIG. 7A is a schematic drawing in section with portions broken away showing selected features of end wall assemblies forming portions of a composite box structure mounted on a railway car underframe incorporating teachings of the present invention.
Figure 9:
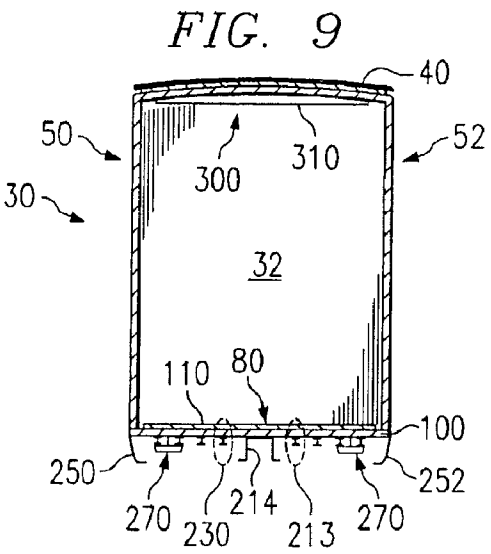
FIG. 9 is a schematic drawing in section taken along lines 9—9 of FIG. 5.
Figure 8:
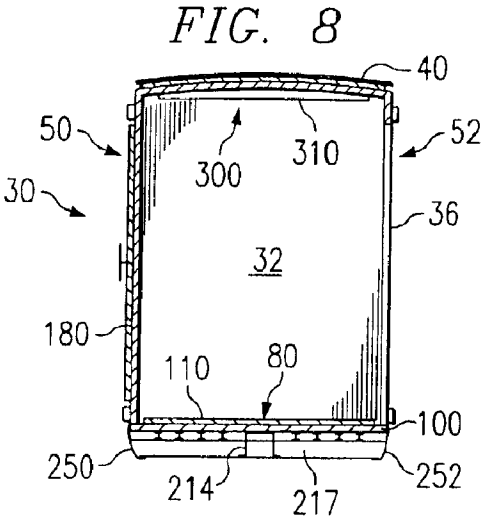
FIG. 8 is a schematic drawing showing a cross section taken along lines 8—8 of FIG. 5.

For embodiments of the present invention as shown in FIGS. 3 and 4 portions of railway car underframe 200 may be manufactured and assembled using conventional railcar manufacturing procedures and techniques. Railway car underframe 200 includes a pair of railway car trucks, 202 and 204, located adjacent to each end of railway car underframe 200. Standard railcar couplings 210 are also provided at each end of railway car underframe 200. Each coupling 210 preferably includes end of car cushioning unit 212 disposed between each end of center sill 214 and the respective coupling 210. Railway car underframe 200 preferably includes a plurality of longitudinal stringers 230. FIGS. 7A, 8 and 9 show portions of floor assembly 80 disposed on longitudinal stringers 230 and attached to railway car underframe 200.

Railway car underframe 200 includes a pair of body bolsters 224 and 226 disposed over respective railway trucks 202 and 204. Body bolsters 224 and 226 extend laterally from center sill 214. For the embodiment shown in FIG. 3, each body bolster 224 and 226 includes cover plates 228 which extend over the wheels of railway car underframe 202 and 204. Cover plates 228 reinforce openings created in railway car underframe 200 to provide required wheel clearance for railway car or trucks 202 and 204.

Railway car underframe 200 includes center sill 214, longitudinal stringers 230, cross bearers 217, cross ties 216 and body bolsters 222 and 224 arranged in a generally rectangular configuration. Cross bearers 217 and cross ties 216 are attached to and extend laterally from center sill 214. Longitudinal stringers 230 are preferably spaced from each other extending parallel with center sill 214. The number of cross bearers, cross ties and longitudinal stringers may be varied depending upon desired load carrying characteristics for the resulting insulated boxcar or temperature controlled railway car.

Each longitudinal stringer 230 preferably includes first surface 231 and second surface 232 which rests upon cross bearers 217 and cross ties 216. A portion of floor assembly 80 may be adhesively bonded or securely attached (not expressly shown) with portions of first surfaces 231 of longitudinal stringers 230. Other portions of floor assembly 80 may expand and contract relative to longitudinal stringers 230.

A typical railway car underframe includes a pair of side sill assemblies and a pair of end sill assemblies which cooperate with each other to define a generally elongated, rectangular configuration or perimeter for the associated railway car. In accordance with teachings of the present invention, side wall assemblies 50 and 52 are preferably fabricated with respective side sill assemblies 250 and 252 formed as an integral component thereof. End wall assemblies 120 and 122 are also preferably fabricated with at least portions of respective end sill assemblies 220 and 222 formed as integral components thereof.

As previously noted, roof assembly 40, side wall assemblies 50 and 52, floor assembly 80, and end wall assemblies 120 and 122 are preferably fabricated as individual components. Roof assembly 40 may be formed as a vacuum molded, single pour, one piece, glass fiber panel. Alternatively, roof assembly 40 may be formed from one or more pultrusions. Void spaces associated with such pultrusions are preferably filled with an insulating foam. Each component may then be attached to railway car underframe 200 in accordance with teachings of the present invention.

Roof assembly 40 may be formed with a generally elongated, rectangular configuration. The length and width of roof assembly 40 corresponds generally with the desired length and width of composite box structure 30. Roof assembly 40 includes first longitudinal edge 41 and second longitudinal edge 42 spaced from each other and extending generally parallel with each other from first lateral edge 43 to second lateral edge 44. Roof assembly 40 may have a generally arcuate configuration extending from first longitudinal edge 41 to second longitudinal edge 42. See FIGS. 5, 6 and 7*a*. First longitudinal edge 41 and second longitudinal edge 42 are preferably mounted on and attached with adjacent portions of respective side wall assemblies 50 and 52. Lateral edges 43 and 44 are preferably mounted on and attached with respective end wall assemblies 120 and 122. See FIG. 7*a*.

Various types of composite materials and insulating materials may be satisfactory used to form roof assembly 40. For some applications roof assembly 40 may be formed from one or more FRP layers 45 and 46. As shown in FIG. 7*a* FRP layer 45 provides outer surface 38 of roof assembly 40. FRP layer 46 provides interior surface 39 of roof assembly 40. FRP layers 45 and 46 may be bonded with each other to encapsulate insulating layer 47 therebetween. A wide variety of materials having desired thermal insulating characteristics may be satisfactorily used to form insulating layer 47. A plurality of "Z-shaped stiffeners" 48 are preferably disposed within roof assembly 40 extending from first longitudinal edge 41 to second longitudinal edge 42.

Each end wall assembly 120 and 122 preferably includes a respective top chord or top plate 130 attached with upper portions of adjacent metal sheets 54. Roof assembly 40 may be attached to and bonded with respective top chord 64 of side wall assemblies 50 and 52, and top chords or top plates 130 of end wall assemblies 120 and 122. As shown in FIG. 7*a*, insulating foam is preferably disposed within the joints or flexible connections formed between roof assembly 40 and adjacent portions of end wall assemblies 120 and 122.

For one embodiment side wall assembly 50 is preferably mounted on one side of railway car underframe 200 with side sill assembly or bottom chord 250 disposed adjacent to the first ends 217*a* of cross bearers 217 and first ends 216*a* of cross ties 216. In a similar manner side wall assembly 52 is preferably mounted on an opposite side of railway car underframe 200 with side sill assembly or bottom chord 252 disposed adjacent to first ends 217*b* of cross bearers 217 and first end 216*b* of cross ties 216.

As previously noted, side sill assemblies 250 and 252 have approximately the same overall dimensions and configuration. Therefore, only side sill assembly 250 as shown in FIG. 7B will be discussed and described in detail. Side sill assembly 250 has a generally J shaped cross section. The configuration of exterior surface 254 of side sill assembly 250 preferably corresponds with the dimensions of plate F. Supporting member 256 is preferably attached to interior surface 258 of side sill assembly 250. Supporting member 256 provides support for primary floor 100.

A metal angle is preferably attached with interior surface 258 of side sill assembly 250 to provide respective supporting member 256.

Various types of mechanical fasteners and/or welding techniques may be used to attach side sill assemblies 250 and 252 and the respective ends of cross bearers 217 and cross ties 216. For some applications Huck type mechanical fasteners are preferably used to attach side sill assemblies 250 and 252 with the respective cross bearers 217 and/or cross ties 216.

For some applications a plurality of pultruded panels 82 are preferably bonded with each other to form primary floor 100 having a generally rectangular configuration corresponding with the desired interior length and width for composite box structure 30. The length of each pultruded panel 82 preferably corresponds with the approximate desired interior width of composite box structure 30. The number of pultruded panels 82 used to form primary floor 100 is approximately to the desired interior length of composite box structure 30 divided by the width of pultruded panel 82. For some applications one or more pultruded panels with a narrower width then pultruded panels 82 may be used to form primary floor 100 with the desired overall length. Primary floor 100 may then be attached to railway car underframe 200.

Figure 10:
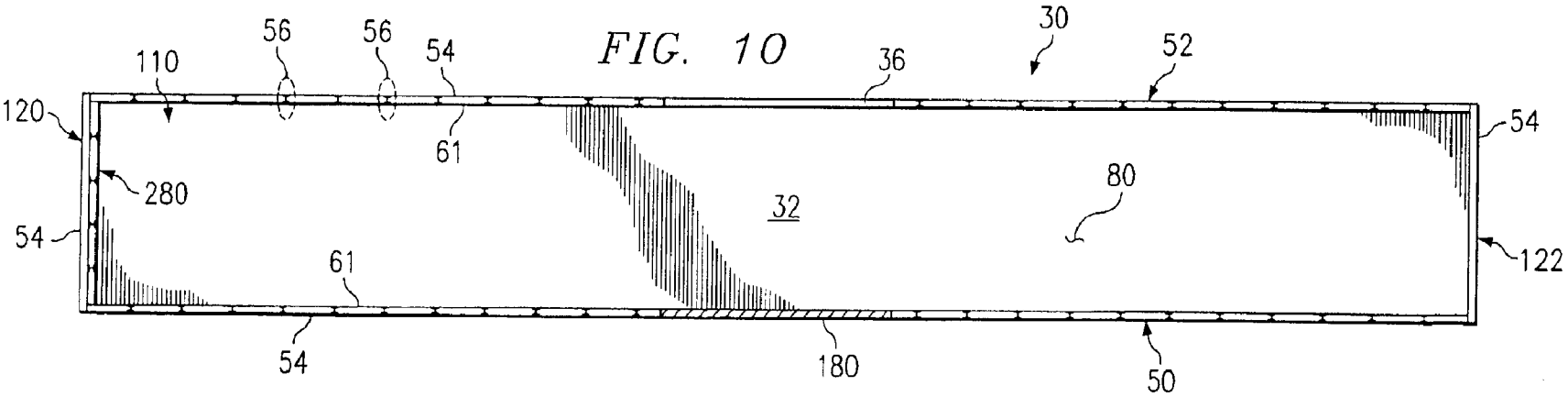
FIG. 10 is a schematic drawing in section taken along lines 10—10 of FIG. 5.

FIGS. 9 and 10 are schematic drawings showing various features of the present invention. For example, side wall assembly 50 is shown with its associated door assembly 180 in its first, closed position blocking access through associated opening 36. Side wall assembly 52 is shown without door assembly 180 which allows access to interior 32 through the associated opening 36. Interior bulkhead 280, which forms a portion of the associated airflow management system 300, is shown in FIG. 10 disposed adjacent to the interior surface of side wall assembly 120.

FIG. 9 shows one example of restraining anchors assemblies 270 which may be formed between portions of primary floor 100 and portions of selected longitudinal stringers 230 near opposite ends of railway car underframe 200. For some applications selected portions of primary floor 100 may be adhesively bonded or securely attached with adjacent portions of railway car underframe 200. Other portions of primary floor 100 which are not bonded with railway car underframe 200 may expand and contract relative to longitudinal stringers 230 as temperature changes occur within composite box 30. For some applications restraining anchor assemblies 270 may be attached with adjacent portions of primary floor 100 and longitudinal stringers 230 to allow limited longitudinal movement of floor assembly 80 relative to railway car underframe 200 and substantially restrict vertical movement of floor assembly 80 relative to railway car underframe 200 during thermal expansion and contraction.

Temperature control system 140 preferably includes refrigeration unit or cooling unit 142 and airflow management system 300 which provides uniform, constant airflow around and through lading carried within composite box structure 30. For some applications such as transporting products in sub-zero, winter environments temperature control system 140 may include a heater. Refrigeration unit 142 may be a self-contained refrigeration unit including a compressor (not expressly shown), a condenser (not expressly shown), airflow blowers (not expressly shown), an external fuel tank 219 and a diesel engine (not expressly shown). For some applications, refrigeration unit 142 may provide airflow in the range of 3200 CFM. Self-contained refrigeration unit 142 provides advantages of easier and faster maintenance as compared to conventional refrigerated boxcars with similar performance characteristics. As a result, temperature control system 140 generally lowers maintenance time and costs and increases the amount of time that temperature controlled railway car 20 remains in service between repairs.

Refrigeration unit 142 may be a programmable unit able to control and maintain desired temperatures within composite box structure 30. Refrigeration unit 142 may include a keypad for inputting data for desired system performance and a microprocessor to control and monitor the functions and performance of refrigeration unit 142 and temperature control system 140. Refrigeration unit 142 may also include a satellite monitoring and control system (not expressly shown) and/or cellular technology to transmit to remote locations information such as the performance and location of refrigeration unit 142 or the temperature inside composite box structure 30. Various types of refrigeration systems are commercially available from companies such as Thermo King, Carrier and Dring. Such units are frequently used in motor carrier trailers and other large containers.

As shown in FIGS. 1A and 1B, refrigeration unit 142 may be mounted on end wall assembly 120 of the composite box structure 30. End platform system 260 may be coupled to railway car underframe 200 near refrigeration unit 142 to provide easy access to refrigeration unit 142. Alternatively, refrigeration unit 142 may be mounted on a secondary end wall or bulkhead (not shown expressly) located within composite box structure 30 to provide better protection for refrigeration unit 142. Refrigeration unit 142 may include an external fuel tank 219 which may be located proximate to refrigeration unit 142. See FIG. 5. This provides the benefit of convenient access to both fuel tank 219 and refrigeration unit 142.

FIGS. 11–14 are block diagrams which show various steps of forming a temperature controlled railway car or an insulated boxcar in accordance with teachings of the present invention. The sequence of steps shown in FIG. 11—method 500, FIG. 12—method 560, FIG. 13—method 570, or FIG. 14—method 590 may be varied as desired for a specific manufacturing facility or railway car design.

For some applications, all of the steps associated with method 500 may be carried out at the same manufacturing facility. For other applications, one or more of the steps associated with method 500 may be carried out at one or more remotely located facilities. One of the benefits of the present invention includes optimizing the manufacture and assembly of components associated with a composite box structure.

In FIG. 11 method 500 for forming a temperature controlled railway car such as previously described railway car 20 starts with the assembly of railway car underframe 200 at step 520. Other steps associated with assembling railway car underframe 200 will be discussed with respect to FIG. 12.

Figure 13:
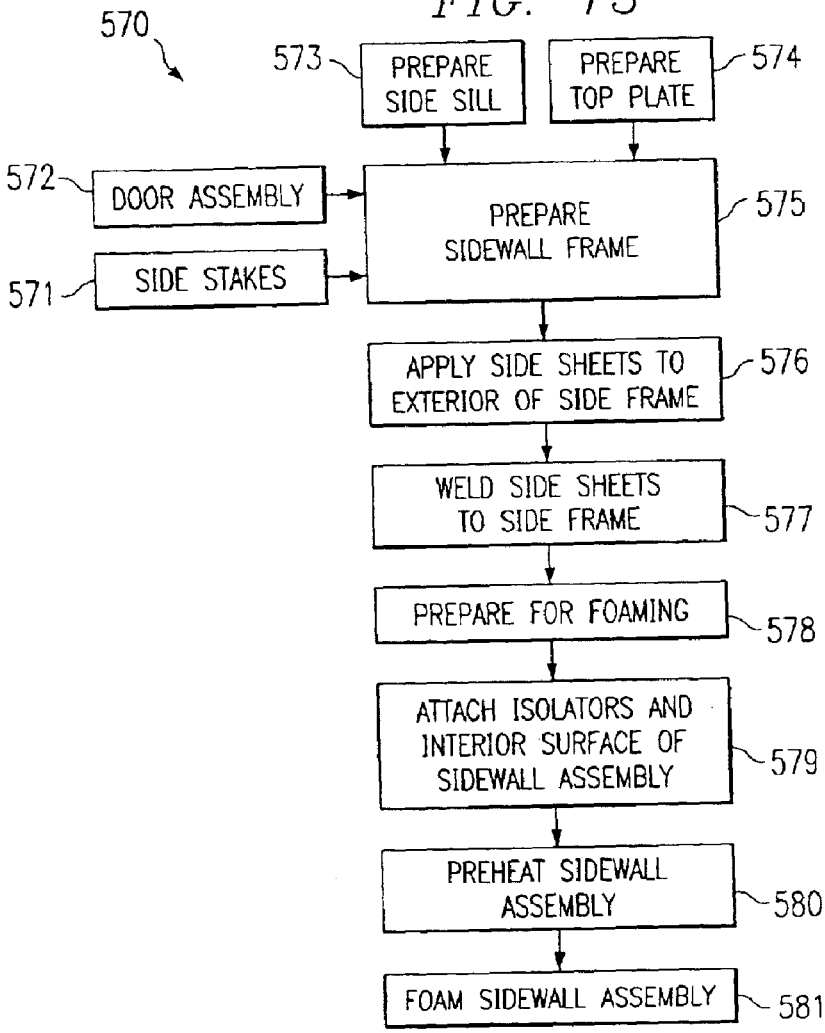
FIG. 13 is a block diagram showing one example of a method for assembling a side wall assembly in accordance with teachings of the present invention.

Side wall assemblies 50 and 52 may be prepared at step 570. Additional steps associated with preparation of side wall assemblies 50 and 52 are shown in FIG. 13. At step 522 side wall assemblies 50 and 52 may be attached with opposite sides of railway car underframe 200.

Primary floor 100 may be prepared for bonding at step 590. At step 524, various components associated with primary floor 100 are applied to and bonded with portions of railway car underframe 200.

Figure 14:
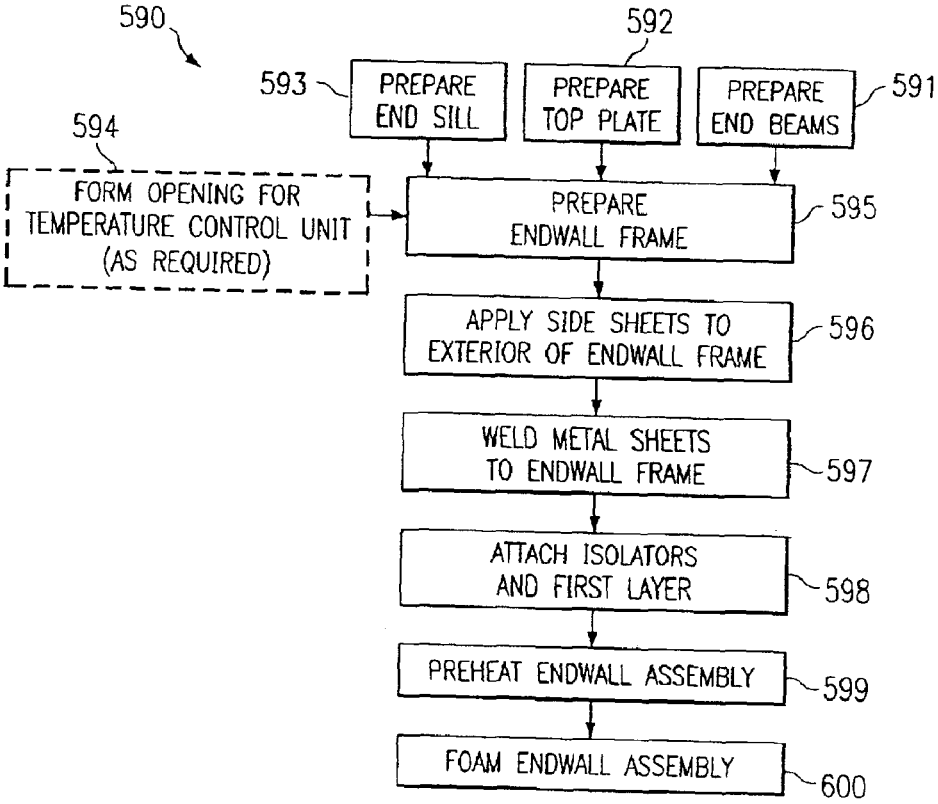
FIG. 14 is a block diagram showing one example of a method for assembling an end wall assembly in accordance with teachings of the present invention.

End wall assemblies 120 and 122 are prepared at step 605. Additional steps associated with manufacturer and assembly of end wall assemblies 120 and 122 are shown in FIG. 14. At steps 526 end wall assemblies 120 and 122 are mounted on and attached to opposite ends of railway car underframe 200. At step 528 any remaining weld out required for railway car underframe 200 and attachment of side wall assemblies 50 and 52 with end wall assemblies 120 and 122 may be completed at step 528.

Roof assembly 40 may be prepared at step 610. At step 530 roof assembly 40 is preferably attached with side wall assemblies 50 and 52 and end wall assemblies 120 and 122 opposite from floor assembly 80 and railway car underframe 200.

Flexible joints and corner joints formed between adjacent portions of side wall assemblies 50, 52, end wall assemblies 120, 122, roof assembly 40 and floor assembly 80 are preferably filled with insulating foam and covered with trim molding at step 534. For some applications blocks of polyurethane foam or blocks of other suitable insulating material may be installed in the joints. Additional liquid insulating foam may then be injected into the joints to complete filling each joint with desired insulating foam. For other applications one or more joints may be filled with only liquid insulating foam to provide the desired resulting foam insulation.

For some applications, as shown in FIG. 7*a*, one or more rows of sealant 248 may be disposed between the ends of primary floor 100 and adjacent portions of end wall assemblies 120 and 122. One or more layers of insulating foam 246 may also be applied over sealant 248. Respective trim molding 75 may then be attached on and bonded with adjacent portions of end wall assemblies 120 and 122 and primary floor 100. Similar trim molding 74 may be attached with adjacent portions of roof assembly 40 and end wall assemblies 120 and 122. Flexible connections and/or joints formed between primary floor 100 and adjacent portions of side wall assemblies 50 and 52, and connections between roof assembly 40 and side wall assemblies 50 and 52 may also be filled with similar sealants and foam insulation.

Respective doors 180 are slidably mounted adjacent to opening 36 in each side wall assembly 50 and 52 at step 536. Various types of safety equipment such as ladders and brake systems may be attached with composite box structure 30 at step 538. Exterior portions of composite box structure 30 may be painted at step 540. Secondary floor 110 may be placed on and bonded with primary floor 100, refrigeration unit 142 attached with the exterior of end wall assembly 120, and interior bulkhead 280 formed within railway car underframe spaced from end wall assembly 120 at step 542. Final inspection of temperature controlled railway car 120 and correction of any further assembly procedures may be completed at step 544.

Figure 12:
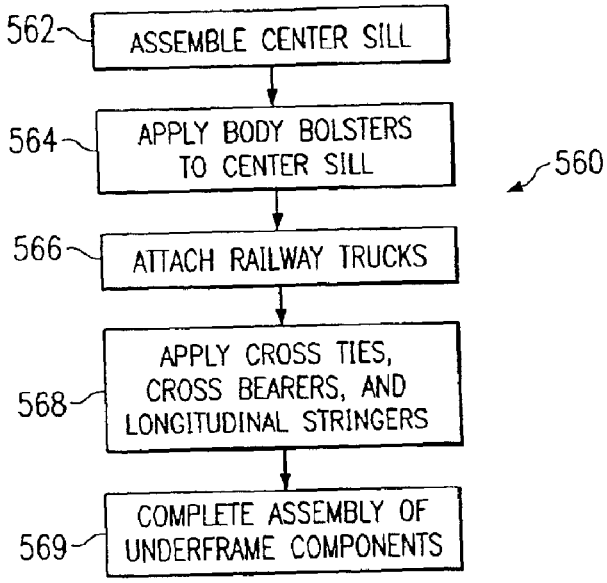
FIG. 12 is a block diagram showing one example of a method for assembling a railway car underframe such as shown in FIGS. 3 and 4.

As shown in FIG. 12 assembly of railway car underframe 200 includes various steps such as assembling center sill 214 at step 562. Respective body bolsters may be attached with center sill 214 at step 564. First railway truck 202 may be attached proximate to the first end of center sill 214. Second railway truck 204 may be attached to the second end of center sill 214 proximate to the second end center sill 214 at step 566. At step 568 a plurality of cross bearers 217 and cross ties 216 may be attached on both sides of center sill 214. A plurality of longitudinal stringers 230 are then placed on cross bearers 217 and cross ties 216 spaced from each other and extending generally parallel with center sill 214. At step 569 assembly of other components associated with railway car underframe 200 may be completed.

Figure 19:
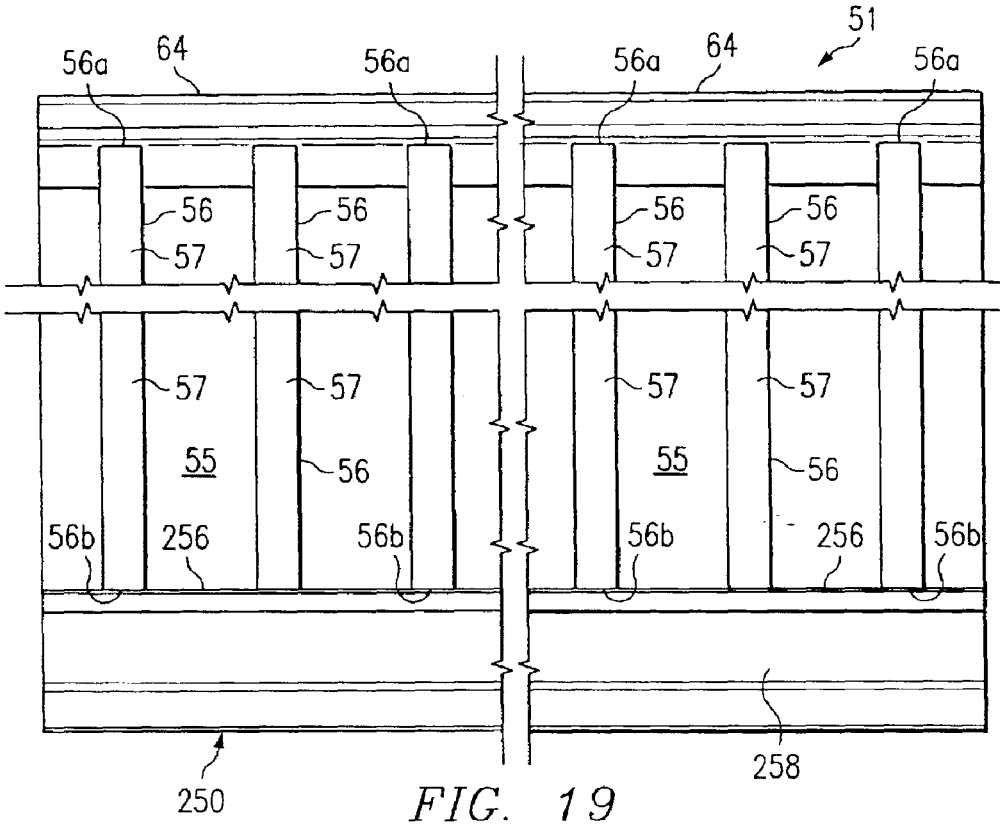
FIG. 19 is a schematic drawing in elevation with portions broken away showing a side wall frame assembly incorporating teachings of the present invention.

As shown in FIG. 13, fabricating a side wall assembly includes various steps such as preparing support posts or side stakes at step 571, preparing a door frame assembly at step 572, preparing a side sill assembly at step 573 and preparing a top chord at step 574. A side wall frame assembly such as shown in FIG. 19 may be prepared at step 575 by attaching support posts 56 with top chord 64 and side sill assembly 250 as previously described. The associated door frame assembly may also be attached with top chord 64 and side sill assembly 250 at the desired location for opening 36.

At step 576, a plurality of metal sheets or side sheets 54 may be placed on the exterior of side wall frame assembly 51. At step 577 metal sheets 54 may be welded with the adjacent portions of side wall frame assembly 51. At step 578 side wall frame assembly 51 may be cleaned. At step 579 isolators 60 are preferably placed on interior surfaces 57 of the support posts 56. Layers 61 of fiber reinforced plastic may also be placed on isolators 60 at step 579. At step 580 the side wall assembly may be preheated. At step 581 the side wall assembly may be placed in a foam press such as shown in FIG. 15 and liquid insulating foam injected into void spaces formed between metal sheets 54, adjacent portions of support posts 56 and the interior surface of the layers 61 of fiber reinforced plastic.

As shown in FIG. 14, fabrication of an end wall assembly includes various steps such as preparing end beam 126 at step 591. Top plate 130 may be prepared at step 592. At least a portion of an end sill assembly such as angle 221 may be prepared at step 593. At step 594 end beams 126 may be attached with first edge plate 129 and second edge plate 131 to form a generally rectangular configuration. Top plate 130 may then be attached adjacent to one end of edge plates 129 and 131. The portion of the end sill assembly may be attached with opposite ends of edge plates 129 and 131 to form end frame assembly 121. See FIG. 20.

For end wall assembly 120, step 594 may also be carried out, which includes forming a frame for an opening to accommodate an associated temperature control unit. At step 596 metal sheets 54 may be attached with the exterior of end wall frame assembly 121. At step 597 metal sheets 54 may be welded to adjacent portions of end wall frame assembly 121. At step 598 isolators 60 may be attached with the interior surface of the end beams. At step 598, layers 61 of fiber reinforced plastic may also be placed on isolators 60. At step 599 the end wall assembly is cleaned and preheated. At step 600 the end wall assembly is preferably placed in a foam press. See FIG. 15. Liquid insulating foam may be injected through openings (not expressly shown) formed in edge plate 129 or 131. The foam press will preferably provide sufficient heat to form solid foam insulation from the liquid insulating foam.

Figure 15:
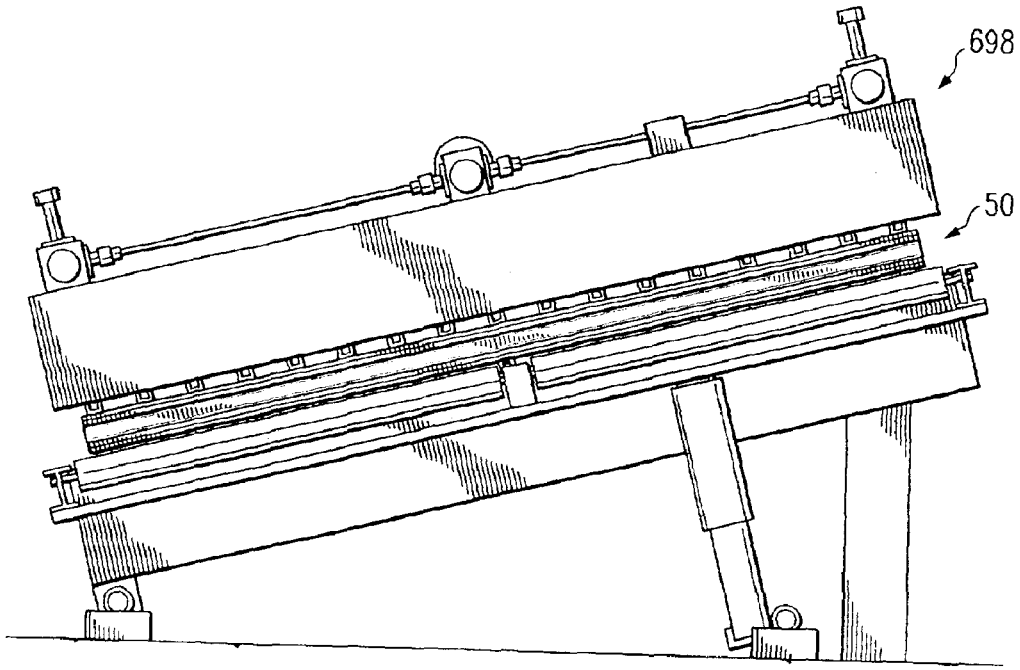
FIG. 15 is a schematic drawing showing an end view of a foam press which may be satisfactorily used to bond liquid insulating foam with portions of a side wall assembly or an end wall assembly to form solid foam insulation in accordance with teachings of the present invention.

FIG. 15 shows one example of a foam press satisfactory for use in forming a side wall assembly or an end wall assembly in accordance with teachings of the present invention. As shown in FIG. 15, foam press 698 may be tilted at an angle of approximately ten (10) degrees. For other applications the angle may be varied between eight (8) degrees and twelve (12) degrees. A foam insulation press satisfactory for use in forming end wall assemblies and side wall assemblies in accordance with teachings of the present invention may be obtained from CON-TEK, Inc. located at 3575 Hoffman Road East, St. Paul, Minn.

Figure 16:
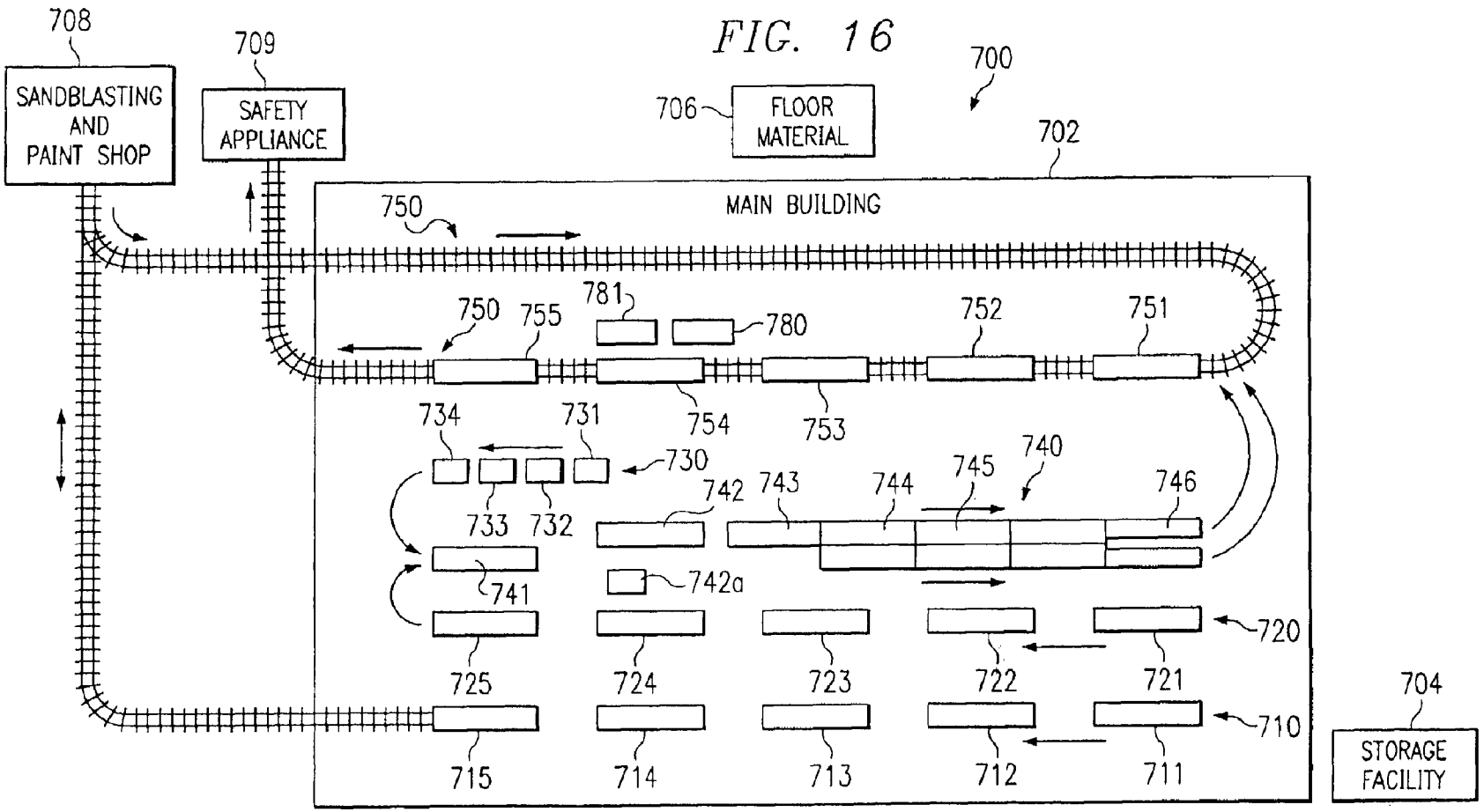
FIG. 16 is a schematic drawing showing a plan view of one example of a manufacturing facility which may be satisfactorily used to manufacture and assemble a temperature controlled railway car or an insulated boxcar in accordance with teachings of the present invention.

One example of a manufacturing facility satisfactory in use in forming a temperature controlled railway car and/or an insulated boxcar in accordance with teachings of the present invention is shown in FIG. 16. Manufacturing facility 700 may include main building 702 and various support facilities such as component storage facility 704, floor material storage facility 706, sand blasting and paint shop 708, and safety appliance assembly facility 710. For embodiments of the present invention as shown in FIG. 16, main building 702 preferably includes assembly line 710 to form a railway car underframe, assembly line 720 to form a side wall frame assembly, assembly line 730 to form an end wall frame assembly, assembly line 740 to complete manufacture of side wall assemblies and end wall assemblies and assembly line 750 for mounting side wall assemblies, end wall assemblies, a floor assembly and a roof assembly on the railway car underframe. Each assembly line 710, 720, 730, 740, and 750 include multiple working stations.

One or more of the assembly lines shown within building 702 may be located at a remote facility. For example, end wall assemblies 120 and 122, formed in accordance with teachings of the present invention may be manufactured at a remote facility (not expressly shown) and shipped to another facility which includes assembly line 750 for mounting the end wall assemblies on a railway car underframe. Also, sand blasting and paint shop facility 708 and/or safety appliance shop 709 may be remotely located from each other and/or main building 702.

Various components required for manufacture and assembly of railway car underframe 200 may be stored within component storage facility 704. At first station 711, components may be moved from storage facility 704 to first station 711 to assemble center sill 214. At second station 712, additional components such as body bolsters 224 and 226 may be attached with center sill 214.

At third station 713, center sill 214 may also be prepared for later attachment of associated draft gear, cushioning units and railway car couplers. At third station 713, additional components such as cross bearers 217, cross ties 216 and portions of end sill assemblies 220 and 222, such as generally c-shaped channels 223, may also be attached with the railway car underframe. At fourth station 714, longitudinal stringers 230 and additional components may be applied with railway car underframe 200. At fifth station 715, temporary railway trucks may be attached with the railway car underframe. The railway car underframe may then be directed to sand blasting and paint shop 708. The resulting railway car underframe may then be directed towards assembly line 750 which will be discussed later in more detail.

Various components may be taken from storage facility 704 and moved to assembly line 720 for use in manufacturing side wall assemblies 50 and 52. At first station 721 side sill assembly or bottom chord 250 and 252 may be assembled. At second station 722 respective top chord 64 may be assembled. At third station 723 support posts 56 may be attached with respective top chord 64 and side sill assembly 250 or 252. At fourth station 724, a plurality of metal sheets 54 may be welded with the exterior of side wall frame assembly 51. See FIG. 19. At fifth station 725, isolators 60 and layers 61 of fiber reinforced material may be placed on support posts 56 opposite from metal sheets 54.

Various components may also be taken from storage facility 704 and moved to assembly line 730 for use in manufacturing end wall assemblies 120 and 122. At first station 731, end beams 126, top plate 130 and angle 221 of end sill assembly 220 may be prepared for use in forming end wall frame assembly 121. See FIG. 20. At second station 732, end wall frame assembly 121 may be formed from respective end beams 126, top plate 130, and angle 221. For end wall assemblies 120, a mounting frame assembly may also be attached for use in installing temperature control unit 142. At third station 733, metal sheets 54 may be placed on the exterior of end wall frame assembly 121 and welded with adjacent portions thereof. At fourth station 734, isolators 60 may be placed on end beams 126 opposite from metal sheets 54. Layer 61 of fiber reinforced material may then be placed on isolators 60.

Side wall assemblies 50 and 52 and end wall assemblies 120 and 122 may be directed to assembly line 740 for injection of liquid insulating foam in associated void spaces to form foam insulation 58. At first station 741, the side wall assemblies and end wall assemblies may be washed and cleaned in preparation for injecting liquid insulating foam. The side wall assemblies may be dried at second station 742 and the end wall assemblies dried at station 742*a*. At third station 743, isolator 60*a* may be bonded with support posts 56 and layer 61 of fiber reinforced material disposed thereon. Side wall assemblies 120 and 122 may then be preheated at four stations 744*a*. End wall assemblies 120 may also be preheated at fourth station 74. A foam press, such as foam press 698 shown in FIG. 15, is preferably provided at fifth station 745. Liquid insulating foam is preferably injected into respective void spaces in side wall assemblies 50 and 522 and end wall assemblies 120 and 122. Foam press 698 provides required temperature control to form foam insulation 58 with bonds between interior surface 55 of side sheets 54, adjacent portions of support post 56 or end beams 126, and interior portion of layer 61. At fifth station 745, the side wall assemblies and end wall assemblies are allowed to cool to complete the foaming and to complete the foam insulation process. At sixth station 746, final assembly of the side wall assemblies and end wall assemblies may be completed.

Side wall assemblies 50 and 52 and end wall assemblies 120 and 122 may then be directed to assembly line 750. At first station 751, side wall assemblies 50 and 52 may be attached with railway car underframe 200. At second station 752, primary floor 100 may be mounted on and attached with selected portions of railway car underframe 200. For example, a center portion of railway car underframe 200 may be securely bonded with adjacent portions of longitudinal stringers 230. Restraining anchors 270 may be attached between other portions of primary floor 100 and railway car underframe 230. See FIG. 9. At third station 713 end wall assemblies may be attached with opposite ends of railway car underframe and side wall assemblies 50 and 52.

One or more roof assemblies may be stored at station 780. At station 781 each respective roof assemblies 40 may be prepared for mounting on a composite box structure in accordance with teachings of the present invention. At fourth station 715 a roof assembly 40 may be attached with side wall assemblies 50 and 52 and end wall assemblies 120 and 122 opposite from railway car underframe. At fifth station 750 door assemblies 180 may be slightably attached with the exterior of each side wall assembly 50 and 52. At stations 753, 754 and/or 755 various flexible connections and corner joints may be foamed with insulation and trim molding applied thereto. From fifth station 755, the resulting railway car may be directed to safety appliance facility 709 for attachment of brakes and other equipment and sand blasting and paint shop 708 to complete the manufacturing assembly of railway car 20.

Figures 17, 18:
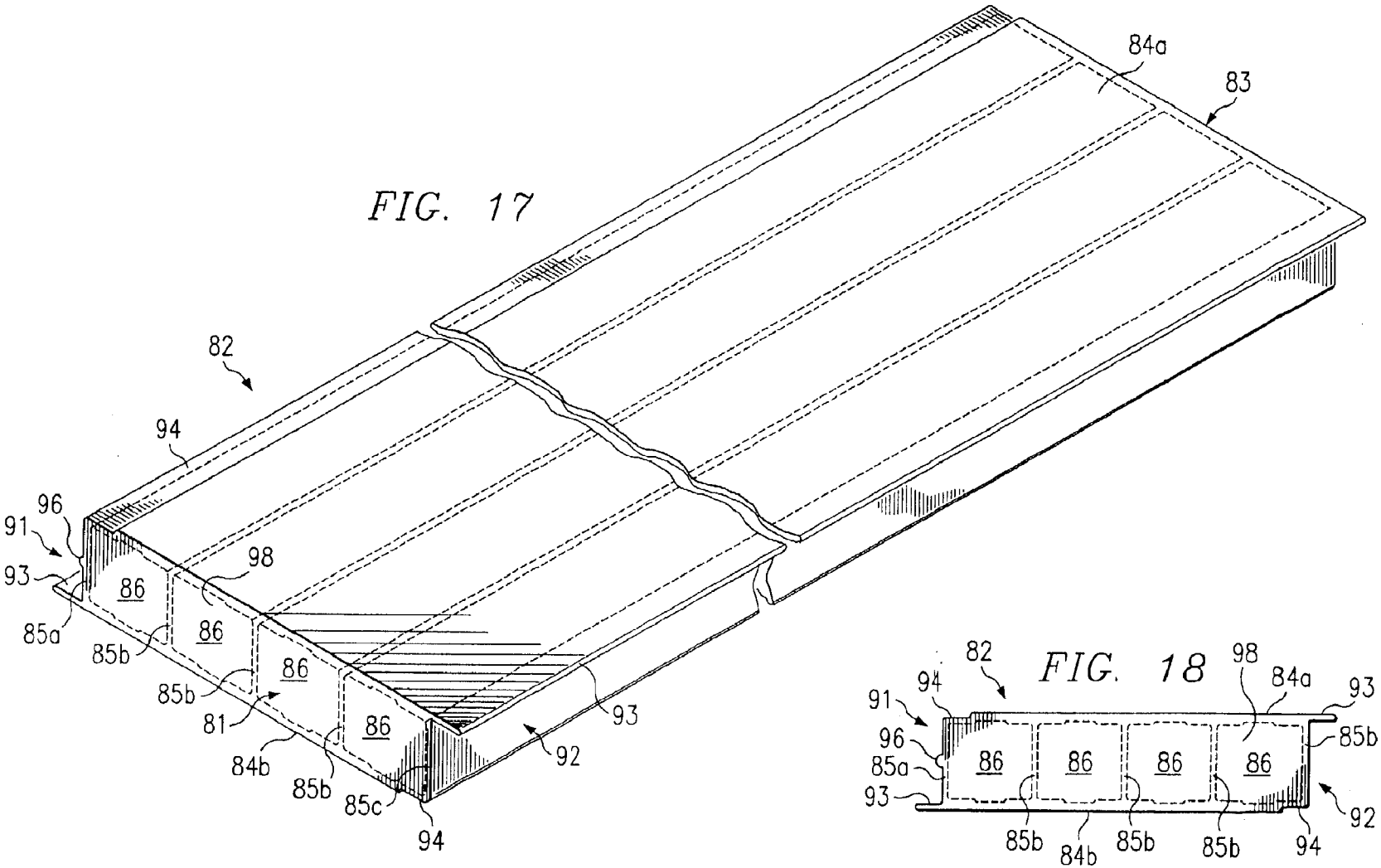
FIG. 17 is a schematic drawing showing an isometric view of one example of a panel satisfactory for use in forming portions of a floor assembly for the temperature controlled railway car of FIGS. 1A and 1B.
FIG. 18 is a schematic drawing showing an end view of the pultruded panel of FIG. 17.

As shown in FIGS. 17 and 18, each pultruded panel 82 may have a generally rectangular configuration defined in part by first end 81 and second end 83 with first longitudinal edge profile 91 and second longitudinal edge profile 92 extending between first end 81 and second end 83. Longitudinal edge profiles 91 and 92 are spaced from each other.

Pultruded panel 82 may include first layer 84*a* and second layer 84*b* with a plurality of webs or dividers 85 disposed therebetween. Webs 85*a* and 85*c* form a portion of respective first longitudinal edge profile 91 and second longitudinal edge profile 92. Webs 85 may have substantially the same dimensions. Void spaces or cavities 86 formed in part by webs 85 may be filled with insulating foam (not expressly shown) having good thermal insulation characteristics. The use of insulating foam substantially reduces heat transfer through the resulting floor assembly 80.

The configuration of longitudinal edge profiles 91 and 92 are preferably selected to engage respective longitudinal edge profiles 91 and 92 of adjacent pultruded panels 82. Longitudinal edge profiles 91 and 92 may include respective flanges or lips 93 which extend laterally therefrom along approximately the full length of the associated pultruded panel 82. Longitudinal edge profile 91 preferably includes recess 94 formed in first layer 84*a*. Longitudinal edge profile 92 preferably includes respective recess 94 formed in second layer 84*b*. The dimensions and configurations of flanges 93 are selected to be compatible with recesses 94 of adjacent pultruded panels 82.

A projection such as bead 96 may be formed along longitudinal edge profile 91. When longitudinal edge profile 91 is engaged with an adjacent longitudinal edge profile 92, bead 96 creates a gap therebetween to allow injection of an adhesive compound into the associated gap (not expressly shown). The adhesive compound (not expressly shown) may be used to bond or couple adjacent pultruded panels with each other. Cover plates or end caps 98 are shown placed over first end 81 and second end 83 to block access to associated void spaces 86. Cover plates 98 prevent moisture or other contaminates from contacting the associated insulating foam and reducing its thermal insulating characteristics. Also, any moisture or liquids which enter void spaces 86 may cause an undesired increase in the weight of the associated pultruded panel 82.

Portions of side wall frame assembly 51 satisfactory for use in forming a side wall assembly in accordance with teachings of the present invention are shown in FIG. 19. For purposes of describing various features of the present invention side wall frame assembly 51 will be described with respect to forming side wall assembly 50. However, side wall frame assembly 51 may be used to form side wall assembly 52. Side wall frame assembly 51 includes a plurality of support posts 56, side sill assembly 250, top chord 64 and attached side sheets 54. Side wall frame assembly 51 may also include a door frame assembly (not expressly shown) required to mount door assembly 180 on side wall assembly 50.

First end 56*a* of each support post 56 is preferably attached to adjacent portions of top chord 64. Second end 56*b* of each support post 56 is preferably attached to adjacent portions of side sill assembly 250. Support posts 56, top chord assembly 64 and side sill assembly 250 cooperate with each other to define a generally elongated, rectangular configuration corresponding with side wall assembly 50. A plurality of metal sheets 54 are preferably attached with the exterior surface of side wall frame assembly 51.

Figure 20:
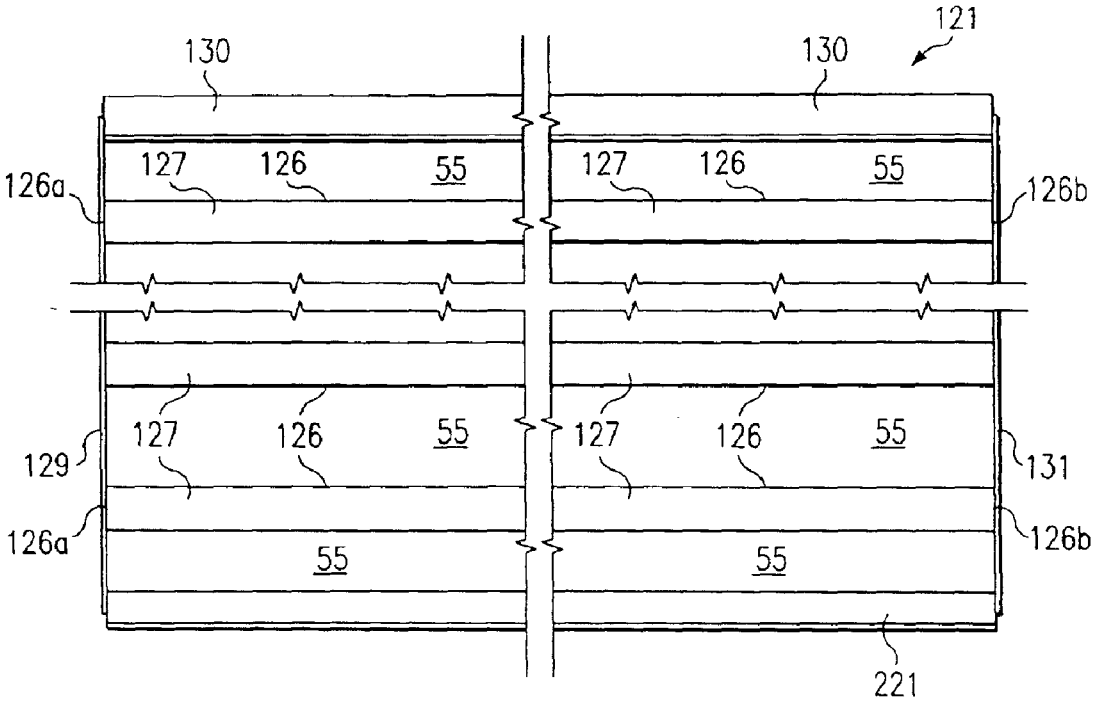
FIG. 20 is a schematic drawing in elevation with portions broken away showing an end wall frame assembly incorporating teachings of the present invention.

Portions of end wall frame assembly 121 formed in accordance of teachings of the present invention are shown in FIG. 20. For purposes of describing various features of the present invention, end wall frame assembly 121 will be described with respect to forming end wall assembly 120. However, end wall frame assembly 121 may be used to form end wall assembly 122. End wall frame assembly 121 includes top plate or top chord 130, angle 221 of end sill assembly 220 with edge plates 129 and 131 attached thereto and extending therebetween. A plurality of openings (not expressly shown) may be formed in edge plate 129 or 131 to allow injecting liquid insulating foam into adjacent void spaces.

First end 126*a* of each end beam 126 is preferably attached to edge plate 129. Second end 126*b* of each end beam 126 is preferably attached to respective portions of edge plate 131. End beams 126 are spaced from each other and extend generally parallel with top plate 130 and the associated angle 221. A plurality of metal sheets 54 may be attached with the exterior of end wall frame assembly 121.

Portions of side wall frame assembly 51 satisfactory for use in forming a side wall assembly in accordance with teachings of the present invention are shown in FIG. 19. For purposes of describing various features of the present invention side wall frame assembly 51 will be described with respect to forming side wall assembly 50. However, side wall frame assembly 51 may be used to form side wall assembly 52. Side wall frame assembly 51 includes a plurality of support posts 56, side sill assembly 250, top chord 64. Side wall frame assembly 51 also includes portions of a door frame assembly 180.

First end 56*a* of each support post 56 is preferably attached to adjacent portions of top chord 64. Second end 56*b* of each support post 56 is preferably attached to adjacent portions of side sill assembly 250. Support posts 56, top chord 64 and side sill assembly 250 cooperate with each other to define a generally elongated, rectangular configuration corresponding with side wall assembly 50. A plurality of metal sheets 54 are preferably attached with the exterior surface of side wall frame assembly 51.

Portions of end wall frame assembly 121 formed in accordance of teachings of the present invention are shown in FIG. 20. For purposes of describing various features of the present invention, end wall frame assembly 121 will be described with respect to forming end wall assembly 120. However, end wall frame assembly 121 may be used to form end wall assembly 122. End wall frame assembly 121 includes top plate or top chord 130, angle 221 with edge plates 129 and 131 attached thereto and extending therebetween. Top plate 130, angle 221, and edge plates 129 and 131 form a generally rectangular configuration corresponding with end wall assembly 120 and 122.

A plurality of end beams 126 may also be attached with edge plates 129 and 131. First end 126*a* of each end beam 126 is preferably attached to edge plate 129. Second end 126*b* of each end beam 126 is preferably attached to respective portions of edge plate 131. End beams 126 are spaced from each other and extend generally parallel with top plate 130 and the associated angle 221. A plurality of metal sheets 54 is preferably attached with the exterior of end wall frame assembly 121.

For some applications a plurality of openings (not expressly shown) may be formed in edge plates 129 and/or 131. The openings may be used to inject liquid insulating foam into respective void spaces when end wall frame assembly 121 with isolators 60 and first layer 61 have been placed into a foam press. The number and size of the openings formed in edge plates 129 and/or 131 will depend upon the configuration and size of associated void spaces formed adjacent to end beams 126.

One temperature controlled railway car formed in accordance with teachings of the present invention has the following features:

286,000 lb. Gross Rail Load;

Standard car equipped with 10'-0" wide by 11'-3½" high insulated single plug door 15" end-of-car cushioning unit;

Meets AAR Plate "F" Clearance Diagram;

State-of-the art temperature control unit, exterior service platform and interior access door;

Satellite monitoring and control system;

An airflow management system installed in the interior of the composite box structure;

High performance insulating materials;

Durable, wood free interior materials; and

No ferrous metals in the interior.

| | |
|---|---|
| Length Inside | 72'-2" |
| Length Over Coupler Pulling Faces | 82'-2" |
| Length over Strikers | 77'-10" |
| Length Between Truck Centers | 52'-0" |
| Truck Wheel Base | 5'-10" |
| Width, Extreme | 10'-6⅝" |
| Width, Inside | 9'-2" |
| Height, Extreme | 16"-11⅞" |
| Height Inside at Center Line of Car | 12'-1½" |
| Estimated Lightweight | 105,000 lbs. |
| Estimated Load Limit - Based on 286,000 lbs. Gross Rail Load | 181,000 lbs. |
| Gross Rail Load | 286,000 lbs. |
| Cubic Capacity (Between bulkheads) | 8,012 cubic feet |
| Cubic Capacity (Level with height of sides) | 7,883 cubic feet |

Although the present invention and its advantages have been described in detail, it should be understood that various changes, substitutions and alternations can be made herein without departing from the spirit and scope of the invention as defined by the following claims.

What is claimed is:

1. A method for forming a temperature controlled railway car comprising:

forming a railway car underframe having a generally rectangular perimeter defined in part by a first end, a second end and a pair of opposite sides spaced from each other and extending from the first end to the second end;

forming a pair of side wall assemblies and a pair of end wall assemblies with each side wall assembly and each end wall assembly having an exterior metal surface and an interior surface of fiber reinforced material with foam insulation bonded therebetween;

attaching a first side wall assembly with one side of the railway car underframe;

attaching a second side wall assembly with the other side of the railway car underframe;

attaching a primary floor to the railway car underframe;

attaching a first end wall assembly with the first end of the railway car underframe;

attaching a second end wall assembly with the second end of the railway car underframe;

attaching a roof assembly to the side wall assemblies and the end wall assemblies opposite from the primary floor;

applying insulating foam to respective joints formed between the end wall assemblies and the side wall assemblies, the primary floor and the side wall assemblies and the end wall assemblies, and the roof assembly and the end wall assemblies and the side assemblies;

attaching a respective door assembly with an opening formed in each of the side wall assemblies to control access to the railway car; and installing a secondary floor on the primary floor opposite from the railway car underframe.

2. The method of claim 1 further comprising:

forming a respective top chord for each side wall assembly;

forming a respective side sill assembly for each side wall assembly; and attaching a plurality of metal sheets with the respective top chord and the respective side sill assembly to form a generally smooth, exterior metal surface for each side wall assembly.

3. The method of clair 1 further comprising:

forming a respective top plate for each end wall assembly;

forming at least a portion of a respective end sill assembly for each end wall assembly; and attaching a plurality of metal sheets with the respective top plate and respective portion of the end sill assembly to form a generally smooth, exterior metal surface for each end wall assembly.

4. The method of claim 1 further comprising:

forming a top chord for each side wall assembly;

forming a side sill assembly for each side wall assembly;

attaching a plurality of support posts with the respective side sill assembly and top chord;

attaching a plurality of metal sheets with the top chord, support posts and side sill assembly to form an exterior metal surface for the respective side wall assembly;

attaching a layer of fiber reinforced material with the support posts opposite from the metal sheets to form an interior surface for the respective side wall assembly;

injecting liquid insulating foam into void spaces formed between the metal sheets, the support posts and the layer of fiber reinforced material;

applying heat to the liquid insulating foam to form solid foam insulation with bonds between adjacent portions of the metal sheets, support posts and fiber reinforced material; and pressing the layer of fiber reinforced material and liquid insulating foam to maintain desired dimensions of the side wall assembly during formation of the solid foam insulation.

5. The method of claim 1 further comprising:

forming a top plate for each end wall assembly;

forming at least a portion of an end sill assembly for each end wall assembly;

attaching a first edge plate and a second edge plate with respective ends of the top plate and the portion of the end sill assembly;

attaching a plurality of end beams spaced from each other with a first end of each end beam attached to a respective portion of the first edge plate and a second end of each end beam attached to a respective portion of the second edge plate;

attaching a plurality of metal sheets with the top plate, end beams and the portion of the end sill assembly to form an exterior metal surface for the respective end wall assembly;

attaching a layer of fiber reinforced material with the end beams opposite from the metal sheets to form an interior surface for the respective end wall assembly;

injecting liquid insulating foam into void spaces between the metal sheets, the end beams and the layer of fiber reinforced material;

applying heat to the liquid insulating foam to form solid foam insulation with bonds between adjacent portions of the metal sheets, end beams and fiber reinforced material; and pressing the layer of fiber reinforced material and the liquid insulating foam to maintain desired dimensions of the end wall assembly during formation of the solid foam insulation.

6. The method of claim 1 further comprising:

forming each side wall assembly with a plurality of metal sheets having an interior surface and an exterior surface;

attaching support posts with the interior surface of the metal sheets and the respective side sill assembly;

attaching a layer of ballistic resistant fabric with the support posts opposite from the metal sheets to define in part void spaces between the interior surface of the metal sheets, the associated support posts and adjacent portions of the layer of fiber reinforced material;

placing the side wall assembly in a press;

injecting liquid insulating foam into the void spaces associated with each side wall assembly; and applying heat and pressure to the insulating foam to form solid foam insulation with bonds between the interior surfaces of the metal sheets, adjacent portions of the support posts and the layer of ballistic resistant fabric.

7. The method of claim 6 further comprising placing an injection block with openings extending therethrough adjacent to the void spaces for use in injecting the liquid insulating foam into the respective void spaces.

8. The method of claim 6 further comprising preheating each side wall assembly prior to placing the side wall assembly in the press.

9. The method of claim 1 further comprising:

forming each end wall assembly with a plurality of metal sheets having an interior surface and an exterior surface;

attaching end beams with the interior surfaces of the metal sheets;

attaching a layer of ballistic resistant material with the support posts opposite from the metal sheets to define in part void spaces between the interior surfaces of the metal sheets, the associated end beams and adjacent portions of the layer of ballistic resistant fabric;

placing the end wall assembly in a press;

injecting liquid insulating foam into the void spaces associated with each end wall assembly; and applying heat and pressure to the insulating foam to form solid foam insulation with bonds between the interior surface of the metal sheets, adjacent portions of the support posts and the layer of ballistic resistant fabric.

10. The method of claim 9 further comprising preheating each end wall assembly prior to placing the end wall assembly in the press.

11. A method for forming an insulated railway car comprising:

forming a railway car underfranie having a generally elongated, rectangular perimeter defined in part by a first end and a second end and a first side and a second side spaced from each other and extending longitudinally from the first end to the second end;

forming a pair of side wall assemblies and a pair of end wall assemblies with each end wall assembly and each side wall assembly respectively formed from a plurality of metal sheets having respective exterior surfaces and interior surfaces;

attaching a plurality of support posts spaced from each other with the interior surfaces of the metal sheets associated with each side wall assembly extending between a respective side sill assembly and a respective top chord;

attaching a plurality of end beams spaced from each other with the interior surfaces of the metal sheets associated with each end wall assembly;

attaching respective isolators to each support post and each end beam opposite from the attached metal sheets;

placing layers of fiber reinforced plastic on the isolators to form respective interior surfaces for the side wall assemblies and the end wall assemblies;

placing liquid insulating foam within void spaces formed between the metal sheets, support posts, end beams and layers of fiber reinforced plastic;

bonding resulting foam insulation with the interior surfaces of the metal sheets, adjacent support posts, adjacent end beams and adjacent portions of the fiber reinforced plastic;

coupling the side sill assembly of each side wall assembly with the railway car underframe; and coupling the portion of the end sill assembly of each end wall assembly with the railway car underframe.

12. The method of claim 11 further comprising attaching respective pieces of trim molding with flexible joints formed between the side wall assemblies and the end wall assemblies.

13. A method of forming a side wall assembly for a composite box structure comprising:

attaching a plurality of support posts with one side of a plurality of metal sheets;

attaching at least one layer of fiber reinforced material with the support posts opposite from the metal sheets to form a plurality of void spaces between the metal sheets, the support posts and the layer of fiber reinforced material;

placing the side wall assembly in a foam press with the side wall assembly tilted at an angle;

injecting liquid insulating foam into the respective void spaces; and applying pressure and heat to the liquid insulating foam to form solid foam insulation having bonds with the metal sheets, adjacent support posts and adjacent portions of the fiber reinforced material.

14. The method of claim 13 further comprising:

attaching a side sill assembly with one end of each support post and one edge of the metal sheets;

attaching a top chord with an opposite edge of the metal sheets and an opposite end of each support post;

inserting an injection block having a plurality of holes extending theretbrough into respective void spaces adjacent to the top chord; and injecting the liquid insulating foam into the associated void spaces through the holes in the injection block.

15. The method of claim 13 further comprising placing the side wall assembly in the foam press with the side wall assembly tilted at an angle between approximately eight degrees and twelve degrees.

16. A method of forming an end wall assembly for a composite box structure comprising:

attaching a plurality of end beams with one side of a plurality of metal sheets;

attaching at least one layer of fiber reinforced material with the end beams opposite from the metal sheets to form a plurality of void spaces between the metal sheets, the support posts and the layer of fiber reinforced material;

placing the end wall assembly in a foam press with the end wall assembly tilted at an angle;

injecting liquid insulating foam into the respective void spaces; and applying pressure and heat to the liquid insulating foam to form solid foam insulation having bonds with the metal sheets, adjacent end beams and adjacent portions of the fiber reinforced material.

17. The method of claim 16 further comprising:

attaching at least a portion of an end sill assembly with one edge of the metal sheets; and attaching a top plate with an opposite edge of the metal sheets.

18. The method of claim 16 further comprising placing the end wall assembly in the foam press with the end wall assembly tilted at an angle between approximately eight degrees and twelve degrees.

19. A method of forming an insulated railway car comprising:

forming a railway car underframe with a center sill and a pair of body bolsters extending laterally therefrom and spaced respectively from a first end and a second end of the center sill, a first railway truck proximate one of the body bolsters, a second railway truck proximate the other body bolster, and a plurality of cross bearers and cross ties spaced from each other and extending generally parallel with the center sill;

placing a plurality of longitudinal stringers on the cross bearers and cross ties with the longitudinal stringers spaced from each other and extending generally parallel with the center sill whereby the longitudinal stringers, the cross bearers and the cross ties cooperate with each other to form a generally elongated, rectangular configuration;

forming a pair of side wall assemblies with each side wall assembly having a respective side sill assembly formed an integral component thereof;

installing insulating foam in each side wall assembly;

forming a pair of end wall assemblies with each end wall assembly having a respective end sill assembly formed as an integral component thereof;

installing insulating foam in each end wall assembly;

attaching one of the side wall assemblies with the railway car underframe by forming a plurality of mechanical couplings between the associated side sill assembly and respective ends of the cross bearers and cross ties;

attaching the other side wall assembly with the railway car underframe by forming a plurality of mechanical couplings between the associated side sill assembly and respective ends of the cross bearers and cross ties;

attaching one of the end wall assemblies with one end of the railway car underfrarne by forming a plurality of mechanical couplings between the railway car underframe and the respective end sill assembly; and attaching the other end wall assembly with the other end of the railway car underframe by forming a plurality of mechanical coupling between the railway car underframe and the respective end sill assembly.

20. The method of claim 19 comprising:

forming each side sill assembly with a generally J shaped cross section; and forming a respective support member on an interior surface of each side sill assembly with the support member extending longitudinally from proximate one end of the side sill assembly to proximate an opposite end of the side sill assembly.

21. A manufacturing facility for use in assembling a railway car having a composite box structure mounted on and attached to a railway car underframe, the manufacturing assembly having at least a first assembly line comprising:

a first station for attaching a pair of side wall assemblies with the railway car underframe;

a second station for applying a primary floor with the railway car underframe;

a third station for attaching a pair of end wall assemblies with the railway car underframe;

a fourth station for completing attachment of the side wall assemblies and the end wall assemblies with the primary floor and the railway car underframe;

a fifth station for applying a roof assembly to the side wall assemblies and the end wall assemblies opposite from the primary floor; and a sixth station for hanging doors on respective openings formed in each side wall assembly.

22. The manufacturing facility of claim 21 including a second assembly line comprising:

a first station for respectively attaching body bolsters adjacent to opposite ends of a center sill;

a second station for attaching cross bearers and longitudinal stringers with the center sill; and a third station for attaching railway car trucks with the center sill adjacent to the body bolsters.

23. The manufacturing facility of claim 21 including a second assembly line comprising:

a first station to form a side sill assembly;

a second station to form a top chord;

a third station to attach support posts spaced from each other and coupled with the top chord and the side sill assembly;

a fourth station to attach metal sheets with an exterior of the top chord, side sill assembly and support posts; and a fifth station for applying a layer of fiber reinforced material with the support posts opposite from the metal sheets.

24. The manufacturing facility of claim 21 including a second assembly line comprising:

a first station to form a top plate;

a second station to form an end sill assembly;

a third station to attach end beams spaced from each other and coupled with a first edge plate and a second edge plate;

a fourth station to attach a plurality of metal sheets with an exterior of the end frame assembly; and a fifth station to attach a layer of fiber reinforced material with the end beams opposite from the metal sheets.

25. The manufacturing facility of claim 21 having a second assembly line comprising:

a first station for washing interior surfaces of the side wall assembly or the end wall assembly;

a second station for drying the end wall assembly or the side wall assembly;

a third station for preheating the end wall assembly or the side wall assembly;

a fourth station for injecting liquid insulating foam and applying heat and pressure to form solid foam insulation in the respective side wall assembly or the end wall assembly; and a fifth station to complete the end wall assembly or side wall assembly.

26. A method for forming a side wall assembly comprising:

forming a side sill assembly and a top chord;

installing support posts and door posts between the top chord and the side sill assembly;

welding the support posts and door posts with the top chord and the side sill assembly to form a side wall frame having an opening for a door;

attaching metal sheets to an exterior of the side wall frame;

welding portions of the metal sheets with adjacent portions of the side wall frame;

cleaning interior surfaces of the metal sheets and the side wall frame;

attaching a strip of insulating material with the support posts opposite from the metal sheets;

attaching at least one layer of fiber reinforced material with the strips of insulating material to form an interior surface of the side wall assembly;

preheating the side wall assembly;

injecting liquid insulating foam into the side wall assembly between the metal sheets and the layer of fiber reinforced material; and heating and pressing the liquid insulating foam to form solid foam insulation bonded with interior surfaces of the metal sheets, adjacent portions of the support posts and adjacent portions of the layer of fiber reinforced material.

27. A method for forming an end wall assembly comprising:

forming at least a portion of an end sill assembly and a top plate;

welding a first edge plate and a second edge plate with the top plate and the portion of end sill assembly to form an end wall frame assembly;

attaching a plurality of end beams with the first plate and the second edge plate by securing a first end of each end beam with a respective portion of the first edge plate and attaching a second end of each end beam with a respective portion of the second edge plate;

attaching metal sheets to an exterior of the end wall frame assembly;

cleaning interior surfaces of the metal sheets and the end wall frame assembly;

attaching isolators with the end beams opposite from the metal sheets;

attaching at least one layer of fiber reinforced material with the isolators to form an interior surface of the end wall assembly;

preheating the end wall assembly;

injecting liquid insulating foam into the end wall assembly between the metal sheets and the layer of fiber reinforced material; and heating and pressing the liquid insulating foam to form solid foam insulation bonded with interior surfaces of the metal sheets, adjacent portions of the end beams and adjacent portions of the layer of fiber reinforced material.

* * * * *